US007697873B2

(12) United States Patent
Matsuura et al.

(10) Patent No.: US 7,697,873 B2
(45) Date of Patent: Apr. 13, 2010

(54) DEVELOPMENT APPARATUS, IMAGE FORMING APPARATUS AND DEVELOPING METHOD THAT EMPLOY A MAGNETIC BRUSH

(75) Inventors: Masahiko Matsuura, Suita (JP); Toshiya Natsuhara, Takarazuka (JP); Junya Hirayama, Takarazuka (JP); Takeshi Maeyama, Kawanishi (JP); Shigeo Uetake, Takatsuki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 225 days.

(21) Appl. No.: 11/711,089

(22) Filed: Feb. 26, 2007

(65) Prior Publication Data

US 2007/0206976 A1 Sep. 6, 2007

(30) Foreign Application Priority Data

Mar. 1, 2006 (JP) ..... 2006-054697
Jan. 10, 2007 (JP) ..... 2007-002255

(51) Int. Cl.
*G03G 15/08* (2006.01)

(52) U.S. Cl. ..... 399/281; 399/282; 399/55; 399/283

(58) Field of Classification Search ..... 399/272, 399/281–283, 55, 53, 252, 267, 270, 273; 430/122.8, 110.4
See application file for complete search history.

(56) References Cited

U.S. PATENT DOCUMENTS 4,568,625 A * 2/1986 Uchiyama et al. ..... 430/108.21
5,953,570 A * 9/1999 Hirai ..... 399/282
5,991,587 A * 11/1999 Kikuchi ..... 399/282
6,512,909 B2 * 1/2003 Ozawa et al. ..... 399/270
6,721,516 B2 4/2004 Aoki et al.
2002/0160292 A1 * 10/2002 Goto et al. ..... 430/110.4

(Continued)

FOREIGN PATENT DOCUMENTS

JP S59-100471 6/1984

(Continued)

OTHER PUBLICATIONS

Machine Translation of Kobayashi et al. (JP Pub. 2003-215855).*

*Primary Examiner*—David M Gray
*Assistant Examiner*—Laura K Roth
(74) *Attorney, Agent, or Firm*—Brinks Hofer Gilson & Lione

(57) ABSTRACT

In a development apparatus of the hybrid method using a component developer, a development apparatus and a development method are provided that prevent the reduction of density or the occurrence of residual images (ghost images) and can carry out good image forming over a long period of time. A development apparatus has the feature that the surfaces of the toner supporting member and the developer supporting member move in a mutually opposite direction at the part where they are opposite to each others. The development apparatus further employs an electric field in the closest part applied in a direction to recover the toner from the toner supporting member to the developing supporting member, wherein the magnitude of the electric field is in the range from $2.5\times10^6$ V/m to $5\times10^6$ V/m. The developer of the development apparatus is such that its share (PD) in the space of the closest part of the opposing portion satisfies the following relationship: $0.09 \leqq PD \leqq 650\times Dss$.

10 Claims, 5 Drawing Sheets

U.S. PATENT DOCUMENTS

2003/0186152 A1* 10/2003 Ohno et al. ..... 430/108.8
2004/0038142 A1* 2/2004 Yoshida et al. ..... 430/108.6

FOREIGN PATENT DOCUMENTS

JP 2000-298396 10/2000
JP 2002-108104 4/2002
JP 2003-057882 2/2003
JP 2003-215855 7/2003
JP 2005-189708 7/2005

* cited by examiner

FIG. 4 (a) NO MEMORY PHENOMENON
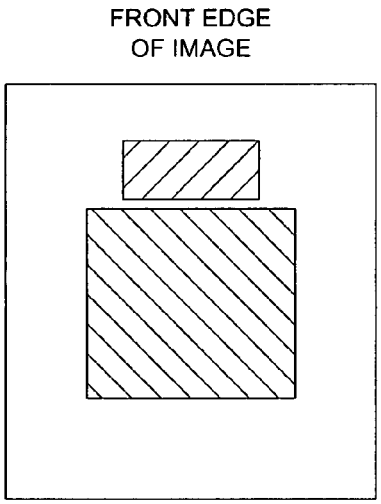
FIG. 4 (b) MEMORY PHENOMENON OCCURRED
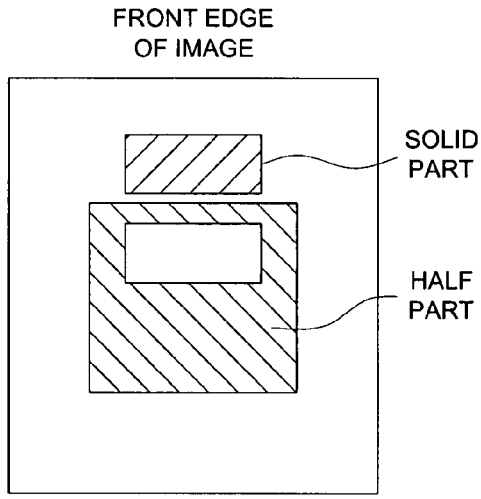

FIG. 5 ( a ) WHEN Vspp IN TABLES 1 TO 8 IS "+"
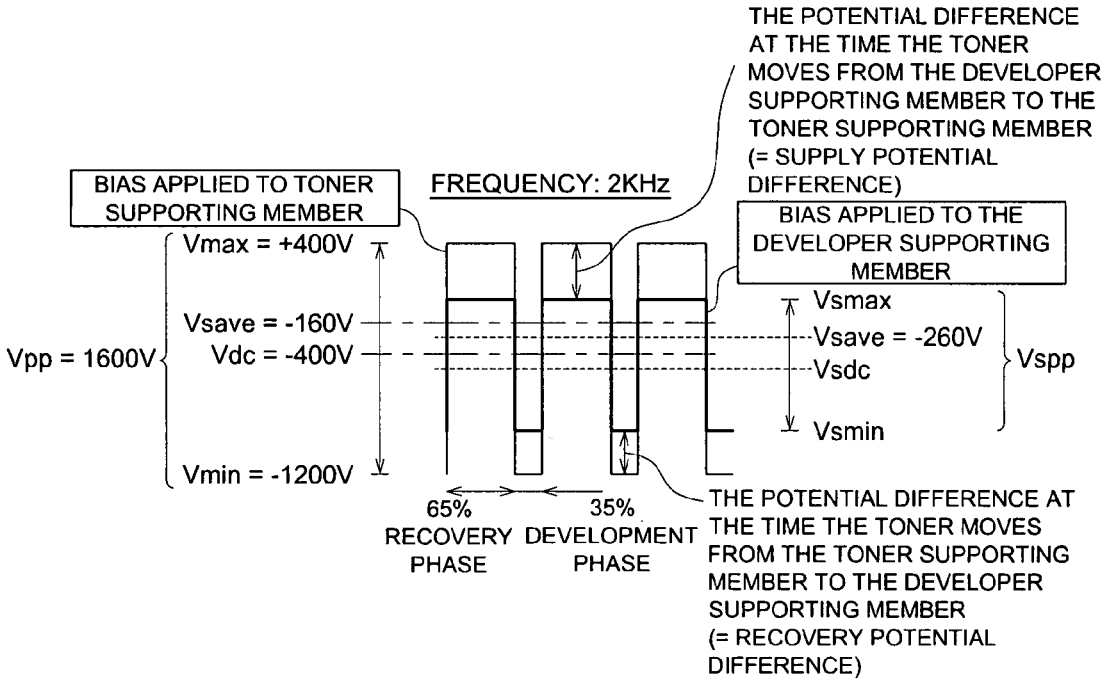
FIG. 5 ( b ) WHEN Vspp IN TABLES 1 TO 8 IS "-"
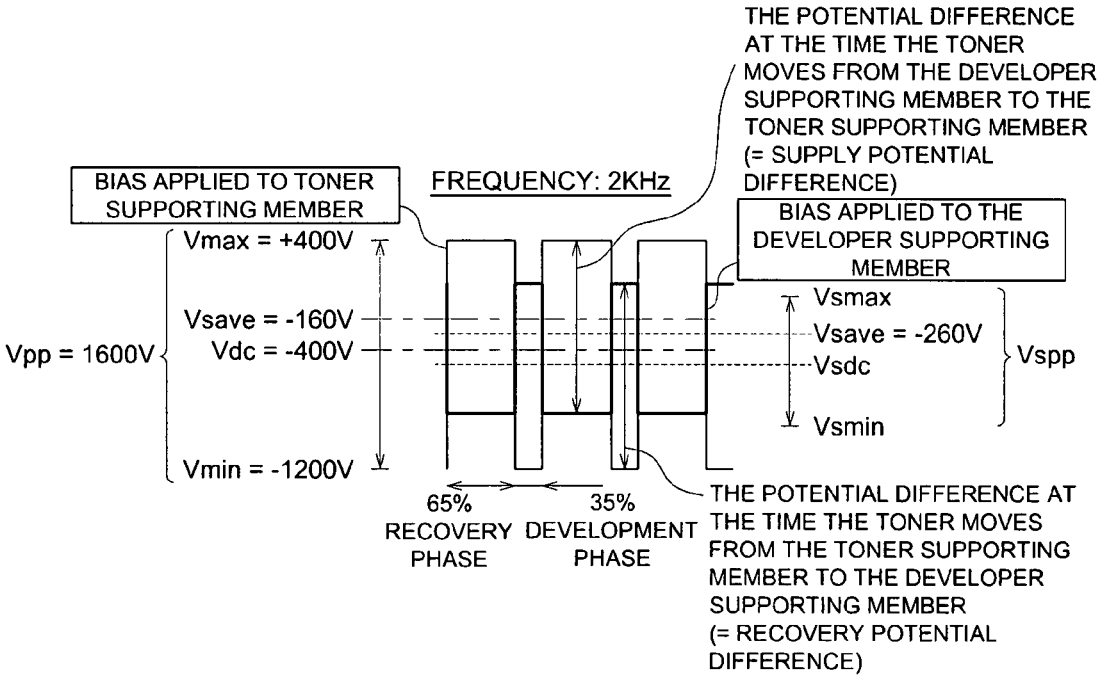

DEVELOPMENT APPARATUS, IMAGE FORMING APPARATUS AND DEVELOPING METHOD THAT EMPLOY A MAGNETIC BRUSH

This application is based on Japanese Patent Application No. 2006-054697 filed on Mar. 1, 2006, and No. 2007-002255 filed on Jan. 10, 2007, in Japanese Patent Office, the entire content of which is hereby incorporated by reference.

TECHNICAL FIELD

The present invention relates to image forming apparatuses such as copying machines, printers, facsimiles, or their all-in-one units, and to the development apparatuses and development methods used therein. In particular, the present invention relates to development apparatuses and image forming apparatuses that use two-component developer having carrier and toner, and develop an electrostatic latent image by retaining only the toner on the developing roller.

BACKGROUND

Conventionally, as the methods of developing the electrostatic latent image formed on the image bearer in an image forming apparatus using the electro-photographic method, known are the one-component developing system which uses only a toner as the developing agent and the two-component developing system which uses toner and a carrier.

Generally, in the one-component developing system, the toner is charged by passing through a regulating section that has a toner supporting member and a regulating plate that is presses by the toner supporting member, and also, it is possible to obtain the desired thin layer of the toner. Because of this, it is advantageous in terms of simplification of the apparatus, size reduction, and achieving low cost. However, it is easy for toner deterioration to progress due to the strong stress of the regulating section, and also it is easy for the charge receiving property of the toner to become lower. In addition, because the surfaces of the regulating member and the toner supporting member, which are members applying charge to the toner, get contaminated by the toner or the external additive agents, even the property of applying charge to the toner gets reduced. Therefore, the amount of charge on the toner decreases, causing problems such as fogging, and hence the life of the development apparatus is short.

On the other hand, in the two-component development system, since the toner is charged by friction charging due to mixing with the carrier, the stress is small, and this method is very effective against toner deterioration. In addition, even the carrier which is the material applying electric charge to the toner, because its surface area is large, is relatively strong against contamination due to toner or external additive agents, and this method is advantageous in terms of life. However, even when a two-component developer is used, the surface of the carrier does get contaminated by the toner and the external additive agents, the amount of charging of the toner gets reduced over a long time of use, and problems such as fogging or toner splashing occur. Because of this, its life can not be said to be sufficient, and still longer life is desired.

In view of this, several proposals have been made of technologies that suppress the deterioration of the carrier and make the life longer of two-component developers (see, for example, Japanese Laid-Open Patent Application Publication No. S59-100471 and No. 2003-215855).

In Patent Japanese Laid-Open Patent Application Publication No. S59-100471 disclosed is a development apparatus that suppresses the increase in the ratio of deteriorated carriers by replenishing the carrier gradually in the developer together with the toner or independently, and the replacement of carrier is carried out in accordance with that by discharging the deteriorated developer the charging property of which has gone down.

Further, in Japanese Laid-Open Patent Application Publication No. 2003-215855, disclosed are a two-component developer having carrier and toner which is externally added with particles having the property of being charged to a polarity opposite to the charging polarity of the carrier and a development method using this developer.

However, in the development apparatus disclosed in Japanese Laid-Open Patent Application Publication No. 2003-215855, since the carriers are being replaced, it is possible to suppress the reduction in the amount of charging of the toner due to carrier deterioration to a fixed level, and this is advantageous in obtaining a long life. However, there are problems in the aspects of cost and environment because a mechanism for retrieving the discharged carrier is necessary, and because the carrier becomes a consumable item. In addition, it is necessary to repeat printing of a prescribed amount until the ratio of old to new carriers becomes stable, and it is not necessarily possible to maintain the initial characteristics.

Further, in Japanese Laid-Open Patent Application Publication No. 2003-215855, it has been indicated that particles with opposite polarity charging property are added with the intention of acting as polishing material and spacer particles, and that there is the effect of suppressing deterioration due to the effect of removing the spent matters on the surface of the carrier. In addition, it is said that there is the effect of improving the cleaning in the image bearer cleaning section and of polishing the image bearer. However, in the disclosed development method, the amount of consumption of the toner and the opposite polarity charging particles differs depending on the image area ratio, particularly when the image area ratio is small, the consumption of the opposite polarity charging particles adhered to the large area non-image area becomes excessive, and there is the problem that the effect of suppressing the carrier deterioration in the development apparatus becomes lower.

In view of this, in order to retain the features of both the development methods, a combined development method (hereinafter referred to as a hybrid development method) appeared that uses a two-component developer in which a non-magnetic toner is charged using a magnetic carrier, and in order to develop the electrostatic latent image formed on the photoreceptor which is the image bearer, the charged toner is separated selectively from the two-component developer and retained on the development roller. Since this hybrid development method can develop by forming a dense toner layer on the development roller and developing in a state of close proximity with the photoreceptor, it is possible to carry out particularly fast image forming, and also, the stress applied to the developer and the development roller is small, and has attracted a lot of attention as a method that can offer long life.

However, while the hybrid development method has the above advantages, on the other hand it came to be known that it also has the following problems.

That is, a toner selection phenomenon occurs in which a toner with a high developing capacity (a toner that can adhere easily to the electrostatic latent image surface due to the developing electric field strength) is easily developed selectively but the toner having a large amount of charge is not consumed but remains on the development roller, and as a consequence, when carrying out successive printing, there is the problem that the image density decreases successively. In addition, there is the problem that the pattern of the previous image appears as a residual image (ghost) at the time of forming the next image.

To counter this problem, a method has been proposed, for example in Japanese Laid-Open Patent Application Publication No. 2002-108104, in which an equipotential state is generated to eliminate the potential difference between the development roller and the feed roller either during the non-image forming period or before starting the image forming, thus decreasing the adhesion force of the toner on the development roller and recovering the residual toner.

Further, for example, in Japanese Laid-Open Patent Application Publication No. 2005-189708, a counteracting method has been proposed of definitely separating the magnetic brush formed on the feed roller using a stirring member by stipulating the positional relationship between the development roller and the feed roller or the amount of two-component developer on the feed roller.

Further, for example, in Japanese Laid-Open Patent Application Publication No. 2000-298396, a method has been proposed of peeling off the residual toner layer after development by making a toner peeling off member come into pressure contact with the development roller.

However, in Japanese Laid-Open Patent Application Publication No. 2002-108104, since a non-image forming period is required, when carrying out image formation successively in high speed, it will not be possible to carry out sufficiently the recovery of residual toner in the period between the previous image and the next image (between images). Further, there is the problem that the printing speed gets reduced if the interval between images is made long. In addition, in Japanese Laid-Open Patent Application Publication No. 2005-189708, although the completeness of the separation of the developer on the feed roller by the stirring member gets improved, it is not possible to sufficiently recover the residual toner on the development roller, and the residual image, which is the pattern of the previous image, remains on the next image. Also, in Japanese Laid-Open Patent Application Publication No. 2000-298396, the drive torque of the development roller becomes high due to the pressure contact of the toner peeling off member, thereby making the motor larger and increasing the cost. In addition, there will be friction of the pressure contacting member and scratches on the development roller thereby causing reduction in the life of the product and noise in the images.

SUMMARY

The purpose of the present invention is to provide, in a hybrid type development apparatus and in an image forming apparatus using it, a development apparatus, an image forming apparatus and a development method that prevent the reduction in density or generation of residual images (ghosts) and can carry out image formation in a stable manner over a long time. In view of forgoing, one embodiment according to one aspect of the present invention is a development apparatus, comprising:

a developer supporting member which supports developer containing toner and carrier on the surface thereof to convey the developer;

a toner supporting member which is disposed facing the developer supporting member to receive the toner transferred from the developer supporting member onto the surface thereof, to convey the toner to a development area, and to cause the developer supporting member to collect the toner having passed through the development area, wherein the surface of the toner supporting member travels to an opposite direction of a traveling direction of the surface of the developer supporting member at an opposing portion between the toner supporting member and the developer supporting member; and an electric field forming mechanism which is adapted to form an alternating electric field between the developer supporting member and the toner supporting member, wherein a strength of an electric field in a direction in which the toner is collected from the toner supporting member onto the developer supporting member is in a range from $2.5\times10^6$ V/m to $5\times10^6$ V/m at the closest portion between the developer supporting member and the toner supporting member, and a share PD of the developer in a space at the closest portion between the developer supporting member and the toner supporting member satisfies the following relationship, $$0.09 \leqq PD \leqq 650\times Dss$$

wherein, $$PD=M/(\rho\times Dss);$$

M ($g/m^2$) is an amount of the developer on the developer supporting member;

Dss (m) is a spacial distance between the developer supporting member and the toner supporting member;

ρ ($g/m^3$) is a density of the developer, ρ satisfying the equation $\rho=\rho t\times TC+\rho c\times(1-TC)$;

ρt ($g/m^3$) is a density of the toner;

ρc ($g/m^3$) is a density of the carrier; and

TC is a mass ratio of the toner in the developer.

According to another aspect of the present invention, another embodiment is an image forming apparatus, comprising:

an image carrier;

an electrostatic latent image forming mechanism which is adapted to form an electrostatic latent image on the image carrier;

a development apparatus which is adapted to develop the electrostatic latent image on the image carrier to form a toner image, the development apparatus including:

a developer supporting member which supports developer containing toner and carrier on the surface thereof to convey the developer;

a toner supporting member which is disposed facing the developer supporting member to receive the toner transferred from the developer supporting member onto the surface thereof, to convey the toner to a development area, and to cause the developer supporting member to collect the toner having passed through the development area, wherein the surface of the toner supporting member travels to an opposite direction of a traveling direction of the surface of the developer supporting member at an opposing portion between the toner supporting member and the developer supporting member;

an electric field forming mechanism which is adapted to form an alternating electric field between the developer supporting member and the toner supporting member, wherein a strength of an electric field in a direction in which the toner is collected from the toner supporting member onto the developer supporting member is in a range from $2.5\times10^6$ V/m to $5\times10^6$ V/m at the closest portion between the developer supporting member and the toner supporting member; and an image transfer mechanism which is adapted to transfer the toner image formed on the image carrier onto a recording media;

wherein a share PD of the developer in a space at the closest portion between the developer supporting member and the toner supporting member satisfies the following relationship, $$0.09 \leqq PD \leqq 650 \times Dss$$

wherein, $$PD = M/(\rho \times Dss);$$

M ($g/m^2$) is an amount of the developer on the developer supporting member;

Dss (m) is a spacial distance between the developer supporting member and the toner supporting member;

ρ ($g/m^3$) is a density of the developer, p satisfying the equation $\rho = \rho t \times TC + \rho c \times (1 - TC)$;

ρt ($g/m^3$) is a density of the toner;

ρc ($g/m^3$) is a density of the carrier; and TC is a mass ratio of the toner in the developer.

According to another aspect of the present invention, another embodiment is a developing method, comprising the steps of:

causing a developer supporting member to support developer containing toner and carrier;

causing a surface of a toner supporting member, which is disposed facing the developer supporting member, to travel in a direction opposite to a traveling direction of the surface of the developer supporting member at an opposing portion between the toner supporting member and the developer supporting member;

forming an alternating electric field between the developer supporting member and the toner supporting member so that the strength of the electric field in a direction in which the toner is collected from the toner supporting member onto the developer supporting member is in a range from $2.5 \times 10^6$ V/m to $5 \times 10^6$ V/m at the closest portion between the developer supporting member and the toner supporting member; and setting a share PD of the developer in a space at the closest portion between the developer supporting member and the toner supporting member so as to satisfy the following relationship, $$0.09 \leqq PD \leqq 650 \times Dss$$

wherein, $$PD = M/(\rho \times Dss);$$

M ($g/m^2$) is an amount of the developer on the developer supporting member;

Dss (m) is a spacial distance between the developer supporting member and the toner supporting member;

ρ ($g/m^3$) is a density of the developer, ρ satisfying the equation $\rho = \rho t \times TC + \rho c \times (1 - TC)$;

ρt ($g/m^3$) is a density of the toner;

ρc ($g/m^3$) is a density of the carrier; and

TC is a mass ratio of the toner in the developer.

BRIEF DESCRIPTION OF THE DRAWINGS

FIGS. 4(*a*) and 4(*b*) show sample images for evaluating occurrence of memory.

FIGS. 5(*a*) and 5(*b*) show schematically the state of application of voltage in examples of experiments.

DETAILED DESCRIPTION OF THE PREFERRED EMBODIMENT

Figure 1:
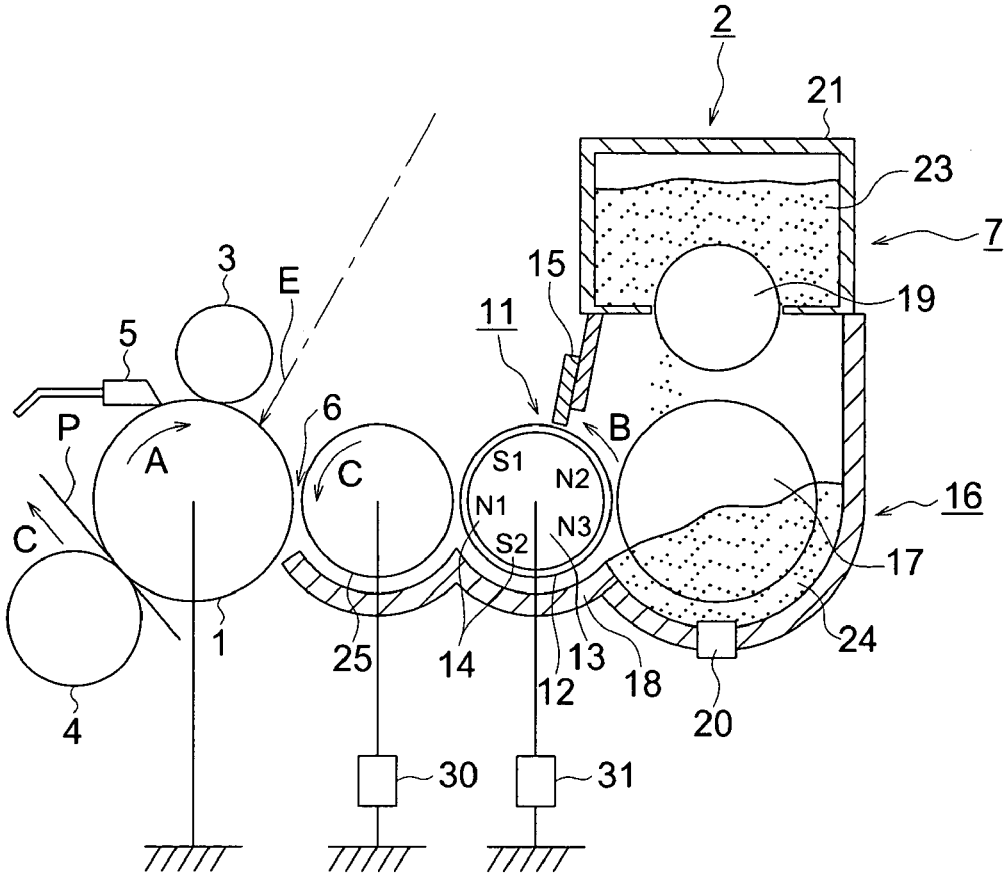
FIG. 1 shows an outline configuration diagram of the essential part of an image forming apparatus according to a preferred embodiment of the present invention.

A preferred embodiment of the present invention is explained in detail as an example in the following while referring to the drawings. However, the dimensions, materials, shape, or their relative placements, etc., of the constituent parts described in the present preferred embodiment are not to be constructed to restrict the scope of the present invention to them, unless specifically described otherwise. It is to be understood that changes and variations may be made without departing from the spirit or scope of the appended claims.

FIG. 1 shows an outline configuration diagram of the essential part of an image forming apparatus according to a preferred embodiment of the present invention.

<Image Forming Apparatus>

This image forming apparatus is a printer that carries out image forming by transferring, on to a transfer medium P such as paper sheets, etc., the toner image formed on an image bearer 1 (photoreceptor) using the electro-photographic method. This image forming apparatus has an image bearer 1 for bearing the image, and in the surroundings of the image bearer 1 are placed a charging unit 3 for charging the image bearer 1, a developing apparatus 2 for developing the electrostatic latent image on the image bearer 1, a transfer roller 4 for transferring the toner image on the image bearer 1, and a cleaning lade 5 for removing the residual toner on the image bearer 1, which are all arranged in that sequence along the direction of rotation of the image bearer 1.

The image bearer 1 is formed by coating a photoreceptor layer on the surface of a grounded base body, and after this photoreceptor layer is charged using the charging unit 3, it is exposed at the position of the point E in the figure by an exposure unit not shown in the figure, thereby forming an electrostatic latent image on its surface. The development apparatus 2 develops the electrostatic latent image on the image bearer 1 into a toner image. The transfer roller 4, after transferring the toner image on the image bearer 1 onto the transfer medium P, discharges it in the direction of the arrow C in the figure. The cleaning blade 5 removes by mechanical force the residual toner remaining on the image bearer 1 after the transfer. The image bearer 1, the charging unit 3, the exposure unit, the transfer roller 4, and the cleaning blade 5, etc. can arbitrarily employ any well-known electro-photography technology. For example, although a charging roller has been shown in the figure as a charging unit, it is also possible to use a charging unit that does not come into contact with the image bearer 1.

<Development Apparatus>

The development apparatus 2 in the present preferred embodiment is provided with a developer tank 16 that stores the developer 24, a developer supporting member 11 that carries on its surface and conveys the developer fed from said developer tank 16, and a toner supporting member 25 that separates the toner from the developer on said developer supporting member 11. In addition, the developer supporting member 11 and the toner supporting member 25 are respectively connected to power supplies 31 and 30. By applying a toner separation bias between the developer supporting member 11 and the toner supporting member 25, the toner in the developer is separated electrically and carried onto the surface of the toner supporting member 25. The toner carried onto the toner supporting member 25 is conveyed to a position opposite the image bearer 1 by the rotation of the toner supporting member 25 and develops the electrostatic latent image on the image bearer 1. After development, the toner remaining on the toner supporting member 25 is mixed into the developer 24 on the developer supporting member 11 at a position opposite the developer supporting member 11, and is recovered. The developer 24 on the developer supporting member 11 that has recovered the residual toner is mixed and stirred in the developer tank 16 at the position opposite the developer tank 16.

The different constituent members within the development apparatus are explained in detail below.

<Developer Supporting Member>

The developer supporting member 11 is made of a magnet roller 13, which is a magnet body of the present invention, placed in a fixed manner, and a sleeve roller 12, which is a rotatable sleeve of the present invention and is free to rotate and encircles the magnet roller 13. The magnet roller 13 has five magnetic poles N1, S2, N3, N2, and S1 along the direction of rotation B of the sleeve roller 12. Among these magnetic poles, the main magnetic pole N1 is placed opposite to the toner supporting member 25, and the same polarity poles N3 and N2 that generate the repulsive magnetic field for separating the developer 24 on the sleeve roller 12 are placed in a position opposite to the interior of the developer tank 16. The direction of rotation B of the sleeve roller 12 of the developer supporting member 11 has been set relative to the direction of rotation C of the toner supporting member 25 so that they are mutually in the opposite directions (counter directions) at the position where they are opposing each other.

<Developer Tank>

The developer tank 16 is formed of a casing 18, and normally, it has inside it a bucket roller 17 for feeding the developer to the developer supporting member 11. At the position of the casing 18 opposite the bucket roller 17, desirably, an ATDC (Automatic Toner Density Control) sensor 20 is placed for detecting the ratio of the toner within the developer (mass ratio) (also called the toner density).

<Toner Replenishment Section>

Normally, the development apparatus 2 has a replenishment section 7 for replenishing into the developer tank 16 the quantity of toner that is consumed in the development area 6, and a regulating member 15 (regulating blade) for making a thin layer of the developer in order to regulate the quantity of developer on the developer supporting member 11. The replenishment section 7 is made of a hopper 21 storing the replenishment toner 23, and replenishment roller 19 for replenishing the toner to the interior of the developer tank 16.

<Toner Supporting Member>

In the development apparatus 2 is used, as a means for separating the toner from the developer on the developer supporting member 11 and developing the electrostatic latent image on the image bearer 1, a toner supporting member 25 made of a material to which it is possible to apply a voltage for separating the toner from the developer on the developer supporting member 11.

The material used for the toner supporting member 25 is, for example, an aluminum roller to which surface treatment has been made. Other than that, also can be used a conductive base body such as aluminum which is coated with resin such as polyester resin, polycarbonate resin, acrylic resin, polyethylene resin, polypropylene resin, urethane resin, polyamide resin, polyimide resin, poly-sulfone resin, polyether ketone resin, polyvinyl chloride resin, vinyl acetate resin, silicone resin, or fluorocarbon resin, or coated with rubber such as silicone rubber, urethane rubber, nitrile rubber, natural rubber, isoprene rubber, etc. The coating materials are not restricted to these. In addition, it is possible to add conductive agent either in the bulk or on the surface of the above coatings. The conductive agent can be an electron conductive agent or an ionic conductive agent. The electronic conductive agents can be carbon black such as Ketzin black, acetylene black, furnace black, etc., or metal powder, or fine particles of metallic oxides, but the conductive agent is not restricted to these. The ionic conductive agents can be cationic compounds such as quaternary ammonium salts, or amphoteric compounds, or other ionic polymer materials, but are not restricted to these. In addition, it can also be a conductive roller made of a metallic material such as aluminum, etc.

<Separation and Recovery of Toner>

The toner supporting member 25 is connected to the power supply 30 and a prescribed toner separation bias is applied (the electric field formed between the toner supporting member 25 and the developer supporting member 11 is called the toner separation electric field), and because of this, the toner in the developer is electrically separated and carried onto the surface of the toner supporting member 25. No separating members such as a blade that contacts the toner supporting member are used.

As the toner separation electric field, the strength of the electric field in the direction of recovering the toner from the toner supporting member 25 to the developer supporting member 11 is in the range from $2.5\times10^6$ V/m to $5\times10^6$ V/m, and also, the ratio (PD: Packing Density) of the developer in the space of the closest part of said opposing portion at this time satisfies the following relationship (Relationship 1).

$$0.09 \leqq PD \leqq 650 \times Dss \qquad \text{(Relationship 1)}$$

Where, $PD=M/(\rho\times Dss)$. $M(g/m^2)$ is the quantity of the developer on the developer supporting member 11, and $\rho(g/m^3)$ is the density of the developer satisfying the relationship $\rho=\rho t\times TC+\rho c\times(1-TC)$, where $\rho t$ is the density of the toner alone, $\rho c$ is the density of the carrier alone, and TC is the share of the toner in the developer (mass ratio).

The present inventors found out that, in a hybrid development method, after rotating the developer supporting member 11 in the counter direction with respect to the toner supporting member 25, under these conditions, in the opposing portion between the toner supporting member 25 and the developer supporting member 11, the residual toner layer on the toner supporting member 25 after development is taken in sufficiently onto the developer supporting member 11, and it is possible to carry out good image formation without the residual image being formed in the next image. This is estimated as followings. Because of making sufficient amount of residual toner to be present in the opposing portion between the toner supporting member 25 and the developer supporting member 11 by rotating the toner supporting member 25 and the developer supporting member 11 in counter directions, the residual toner on the toner supporting member 25 is separated by the magnetic brush containing toner, and also, the separated toner, due to the electric field applied in the recovering direction in the opposing portion between the toner supporting member 25 and the developer supporting member 11, is recovered on to the developer supporting member 11, and in addition, also because the occurrence of clogging in the opposing portion between the toner supporting member 25 and the developer supporting member 11 and of insufficient toner supply to the toner supporting member 25 are prevented since the electric field in the opposing portion between the toner supporting member 25 and the developer supporting member 11 and the ratio of toner present are set appropriately. Therefore, even if a peeling off member that pushes against and is in contact with the toner supporting member 25 is not provided, it is possible to prevent toner from accumulating on the toner supporting member 25.

When the strength of the electric field in the direction of recovering the toner is less than $2.5\times10^6$ V/m, it is not possible to separate the residual toner layer on the toner supporting member 25 after development from the toner supporting member 25, and sufficiently recover it into the developer on the developer supporting member 11, and residual image (memory) of the previous image is generated in the next image. Further, if it exceeds $5\times10^6$ V/m, the carrier on the developer supporting member 11 gets transferred to the toner supporting member 25, scratches the surface of the image bearer 1, reduces the life of the image bearer 1, and also causes image defects by creating white patches (where no toner gets adhered) in the image.

Further, if the ratio (PD: Packing Density) of the developer in the closest part of the opposing portion between the toner supporting member 25 and the developer supporting member 11 is less than 9% of the volume of the space, the developer on the developer supporting member 11 does not sufficiently contact the surface of the toner supporting member 25, the recovery of the toner on the toner supporting member 25 becomes poor thereby causing the memory phenomenon. Further, if PD exceeds a value of 650×Dss, clogging of the developer occurs in the opposing portion between the toner supporting member 25 and the developer supporting member 11, the carrier gets transferred on to the toner supporting member 25, and in the developing section, it can scratch the image bearer 1, and can get transferred to the surface of the image bearer 1 and cause image noise.

The toner separation bias applied to the toner supporting member 25 differs depending on the charging polarity of the toner, that is, when the toner is charged negative, it is a higher average voltage than the average value of the voltage applied to the developer supporting member 11, and when the toner is charged positively, it is a lower average voltage than the average value of the voltage applied to the developer supporting member 11. Whether the toner is charged to positive polarity or to negative polarity, it is desirable that the electric field strength obtained by dividing the difference between the average voltage applied to the toner supporting member 25 and the average voltage applied to the developer supporting member 11 by the gap (Dss) between the toner supporting member 25 and the developer supporting member 11 is from $5\times10^4$ to $2\times10^6$ V/m. If the electric field is too small, it becomes difficult to separate sufficiently the toner. On the other hand, if the electric field is too large, the carrier that is being retained by magnetic force on the developer supporting member 11 gets separated due to the electric field, and it is likely that the ideal development function is lost in the development area.

The toner separation electric field is usually obtained by applying an alternating voltage to either one of the toner supporting member 25 and the developer supporting member 11 or both. In particular, in order to develop the electrostatic latent image, when an alternating voltage is applied to the toner supporting member 25, it is desirable to form the toner separation electric field using the alternating voltage applied to the toner supporting member 25.

For example, if the toner charging polarity is positive and a DC voltage and an AC voltage are applied to the developer supporting member 11, and only a DC voltage is applied to the toner supporting member 25, only a DC voltage lower than the average value of the voltage (AC+DC) applied to the developer supporting member 11 is applied to the toner supporting member 25. Furthermore, for example, if the toner charging polarity is negative and a DC voltage and an AC voltage are applied to the developer supporting member 11, and only a DC voltage is applied to the toner supporting member 25, only a DC voltage higher than the average value of the voltage (AC+DC) applied to the developer supporting member 11 is applied to the toner supporting member 25.

Furthermore, for example, if the toner charging polarity is positive and only a DC voltage is applied to the developer supporting member 11, and a DC voltage and an AC voltage are applied to the toner supporting member 25, the DC voltage superimposed with an AC voltage applied to toner supporting member 25 is such that its average voltage is lower than the DC voltage applied to the developer supporting member 11. Furthermore, for example, if the toner charging polarity is negative and only a DC voltage is applied to the developer supporting member 11, and a DC voltage and an AC voltage are applied to the toner supporting member 25, the DC voltage superimposed with an AC voltage applied to toner supporting member 25 is such that its average voltage is higher than the DC voltage applied to the developer supporting member 11.

Furthermore, for example, if the toner charging polarity is positive and a DC voltage superimposed with an AC voltage is applied to both the developer supporting member 11 and the toner supporting member 25, the DC voltage superimposed with an AC voltage applied to toner supporting member 25 is such that its average voltage is lower than the average value of the DC voltage superimposed with an AC voltage applied to the developer supporting member 11. Furthermore, for example, if the toner charging polarity is negative and a DC voltage superimposed with an AC voltage is applied to both the developer supporting member 11 and the toner supporting member 25, the DC voltage superimposed with an AC voltage applied to toner supporting member 25 is such that its average voltage is higher than the average value of the DC voltage superimposed with an AC voltage applied to the developer supporting member 11.

In particular, if a DC voltage including an AC electric voltage is applied to both the developer supporting member 11 and the toner supporting member 25 but the phases of the two AC voltages are made opposite to each other, it is not only possible to separate the carrier and the toner in the developer with a smaller AC voltage, but also possible to carry out sufficiently the recovery of residual toner on the toner supporting member 25 after development.

Further, the average voltage mentioned here is that considering the amplitude, phase, frequency, duty cycle, etc., of the AC voltage components that are applied respectively.

The developer remaining on the developer supporting member 11 after the toner has been separated by the toner supporting member 25, that is, the carrier is conveyed as it is by that developer supporting member 11 and is recovered into the developer tank 16.

<Toner>

The toner used is not particularly restricted, and it is possible to use any publicly known toner that is used ordinarily, and it is also possible to use a toner that is produced by including a coloring agent, and if necessary, charging control agent, releasing agent, etc., in a binder resin and is with external additives processed. Although the toner particle diameter is not restricted, it is desirable that it is in the range from 3 to 15 μm.

For the manufacture of this type of toner, it is possible to use a generally used well-known method, for example, it is possible to manufacture using the methods of grinding method, emulsion polymerization method, suspension polymerization method, etc.

For the binder resin used for the toner, although not restricted to these, it is possible to use, for example, styrene type resins (homopolymers or copolymers having styrene or styrene substitutes) or polyester resins, epoxy type resins, vinyl chloride resins, phenol resins, polyethylene resins, polypropylene resins, polyurethane resins, silicone resins, etc. Depending on the individual resin or their combinations of these resins, it is desirable to select those with a softening temperature in the range of 80 to 160° C. and a glass transition temperature in the range of 50 to 75° C.

Further, for the coloring agent, it is possible to use generally used and widely known materials, for example, carbon black, aniline black, activated charcoal, magnetite, benzene yellow, permanent yellow, naphthol yellow, pthalocyanine blue, fast sky blue, ultramarine blue, rose bengal, lake red, etc. can be used, and in general it is desirable to use 2 to 20 parts by mass of these for 100 parts by mass of the above binder resin.

Further, even for the above charging control agent it is possible to use any well-known agents, and as the charging control agent for positively charging toners, it is possible to use, for example, nigrosine series dyes, quaternary ammonium salt type compounds, tri-phenyl methane type compounds, imidazole type compounds, polyamine resin, etc. As the charging control agent for negatively charging toners, it is possible to use azo type dyes containing metals such as Cr, Co, Al, Fe, etc., metal salicylate type compounds, metal acrylic salicylate type compounds, calixarene compounds, etc. Generally, it is desirable to use 0.1 to 10 parts by mass of the charging control agent for 100 parts by mass of the above binder resin.

Further, even for the releasing agent it is possible to use any well-known agents which is generally used, and it is possible to use, for example, polyethylene, polypropylene, carnauba wax, sasol wax, etc., either independently or as combinations of two or more types, and in general, it is desirable to use 0.1 to 10 parts by mass of the releasing agent for 100 parts by mass of the above binder resin.

Further, even for the external additives it is possible to use any of the well-known additives which is generally used, and it is possible to use, for example, fine inorganic particles such as silica, titanium oxide, aluminum oxide, etc., fine particles of resins such as acrylic resin, styrene resin, silicone resin, resins containing fluorine, etc., for fluidity improvement, and in particular, it is desirable to use external additives that have been hydrophobized using silane coupling agent, titanium coupling agent, or silicone oil, etc. Further, such fluidizing agents are used by mixing 0.1 to 5 parts by mass for every 100 parts by mass of the above binder resin. Although the diameters of the particles of the external additives are not particularly restricted, it is desirable that the primary number average particle diameter of external additives is in the range of 10 to 100 nm.

<Carrier>

Although the carrier used is not particularly restricted, it is possible to use any generally used and well-known carrier, and it is possible to use binder type carriers, or coated type carriers. Although the diameters of the particles of the carrier are not particularly restricted, it is desirable that the primary number average particle diameter of the carriers is in the range of 15 to 100 μm.

A binder type carrier is one in which magnetic fine particles are dispersed in a binder resin, and it is possible to provide fine particles, that can be charged positively or negatively, on the surface of the carriers or to provide a surface coating layer on them. The charging characteristics such as the charging polarity, etc., of binder type carriers can be controlled by the types of the material of the binder resin, the chargeable fine particles, and of the surface coating layer.

Some examples of the binder resin used in binder type carriers are thermoplastic resins such as vinyl type resins typified by polystyrene type resins, polyester type resins, nylon type resins, polyolefin type resins, etc., and thermosetting type resins such as phenol resins.

For the magnetic fine particles, it is possible to use spinel ferrites such as magnetite, gamma ferric oxide, etc., spinel ferrites that have one or more types of non-ferrous metals (Mn, Ni, Mg, Cu, etc.,), magneto plumbite type ferrites such as barium ferrite, etc., or particles of iron or alloys with oxide layers on their surfaces. Their shapes can be any of particulate, spherical, or needle shapes. In particular, when high magnetization is necessary, it is desirable to use iron based ferromagnetic fine particles. Further, if chemical stability is considered, it is desirable to use ferromagnetic fine particles of spinel ferrites having magnetite or gamma ferric oxide, or magneto plumbite type ferrites such as barium ferrite, etc. By selecting appropriately the type and content of ferromagnetic fine particles, it is possible to obtain a magnetic resin carrier having the desired magnetization. It is appropriate to add 50 to 90 percent by mass of magnetic fine particles in the magnetic resin carrier.

The attaching of chargeable fine particles or conductive fine particles on the surface of a binder type carrier is done, for example, by first uniformly mixing magnetic resin carriers and fine particles and adhering these fine particles on the surface of magnetic resin carriers, and then applying mechanical and thermal shock force thereby making the fine particles to be shot inside and fixed in the magnetic resin carriers. In this case, the fine particles are not completely buried inside the magnetic resin carriers but are fixed so that a part of them are projecting out from the surface of the magnetic resin carriers. Organic or inorganic dielectric materials are used for the chargeable fine particles. In concrete terms, it is possible to use organic dielectric particles of polystyrene, styrene type copolymers, acrylic resin, various types of acrylic copolymers, nylon, polyethylene, polypropylene, resins containing fluorine, and cross-linked materials of these, etc., and it is possible to obtain the desired level of charging and polarity based on the material, polymerizing catalyst, surface treatment, etc. In addition, it is possible to use inorganic particles with negative charging property such as silica, titanium dioxide, etc., and to use inorganic particles with positive charging property such as strontium titanate, alumina, etc.

On the other hand, coated type carriers are carriers in which carrier core particles made of a magnetic material are coated with resin, and even in the case of coated type carriers it is possible, similar to the case of binder type carriers, to attach fine particles that can be charged to positive or negative polarity on the surface of the carriers. It is possible to control the polarity and charging characteristics of coated type carriers based on the type of the surface coating layer and of the chargeable fine particles, and it is possible to use materials similar to those in the case of the binder type carriers.

It is sufficient to adjust the ratio of mixing the toner and the carrier so that the desired toner charging amount is obtained, and a ratio of toner quantity to the total quantity of toner and carrier of 3 to 50% by mass is appropriate, and more preferably, 6 to 30% by mass.

<Formulating the Developer>

The developer is prepared by mixing the above-mentioned toner and carrier with a prescribed mixing ratio.

It is sufficient to adjust the ratio of mixing the toner and the carrier so that the desired toner charging amount is obtained, and a ratio of toner quantity to the total quantity of toner and carrier of 3 to 50% by mass is appropriate, and more preferably, 6 to 30% by mass.

<Description of Operation of the Development Apparatus—Movement of the Developer>

In the development apparatus 2 shown in FIG. 1, in detailed terms, the developer 24 inside the developer tank 16 is mixed and stirred by the rotation of the bucket roller 17, and after being charged due to friction, it is scooped up by the bucket roller 17 and is fed to the sleeve roller 12 on the surface of the developer supporting member 11. This developer 24 is held on the surface of the sleeve roller 12 due to the magnetic force of the magnet roller 13 inside the developer supporting member 11 (toner supporting member), rotates and moves along with the sleeve roller 12, and has its passage amount regulated by the regulating member 15 provided opposite the toner supporting member 11. Thereafter, in the part opposite to the toner supporting member 25, as has been explained earlier, the toner in the developer is separated selectively and is carried on the toner supporting member 25. The separated toner is conveyed to the development area 6 that is opposite to the image bearer 1. In the development area 6, because of the force applied on the toner by the electric field formed between the electrostatic latent image on the image bearer 1 and the toner supporting member 25 to which a development bias has been applied, the toner on the toner supporting member 25 moves to the electrostatic latent image on the image bearer 1, and hence the electrostatic latent image is developed into a visible image.

The development method can also be a reversal development method or can be a normal development method. The toner layer on the toner supporting member 25 that has passed through the development area 6 is not only stirred magnetically but is also taken into the developer and recovered by coming into contact with the carrier by the magnetic brush at the opposing portion between the toner supporting member 25 and the developer supporting member 11, and also the toner in the developer is supplied to the surface of the toner supporting member 25, and is conveyed again into the development area 6. At this time, regarding the direction of rotation of the toner supporting member 11 and the direction of rotation of the developer supporting member 11 at the opposing portion as shown in FIG. 1, it is desirable that the directions of motion of their surfaces are opposite to each other. By making these directions of motion opposite to each other, because the toner is separated from the developer on the developer supporting member 11 that is entering the opposing portion and is supplied to the toner supporting member 25, the developer density on the developer supporting member 11 decreases and goes into the state in which it is easier to take in toner. Since it comes out at the outlet of the opposing portion in this condition, it becomes easier to recover the residual toner on the toner supporting member 25 after development, and hence it is possible to make the residual image smaller in the image and to form better images.

On the other hand, the developer on the developer supporting member 11 that has passed through the part opposite to the toner supporting member 25 is conveyed as it is towards the developer tank 16, gets removed from the developer supporting member 11 due to the repulsive magnetic force of the same polarity magnetic poles N3 and N2 of the magnet roller provided opposite the bucket roller 17, and is then recovered into the developer tank 16. When the replenishment control section not shown in the figure but provided in the replenishment section 7, in a manner similar to that indicated in FIG. 1, detects that the toner density in the developer 24 has fallen below the minimum toner density necessary for acquiring the image density, it sends the drive start signal to the drive section of the toner replenishment roller 19, and the replenishment toner 23 is fed to the interior of the developer tank 16.

Another preferred embodiment of the present invention is explained here which is the case in which the developer includes a carrier, a toner, and opposite polarity particles that are charged to a polarity opposite to the polarity of charging of the toner. The configuration other than the developer is the same as the preferred embodiment described above. The opposite polarity particles compensate for the reduction in the chargeability of the toner due to the deterioration of the carrier caused by continuous image formation for a long time.

In the development apparatus 2 shown in FIG. 1, because of a toner separation bias that separates the toner from the developer being applied between the toner supporting member 25 and the developer supporting member 11, the toner in the developer is electrically separated and carried on the surface of the toner supporting member, at the same time, the opposite polarity particles having a polarity opposite to that of the toner are separated from the toner.

The toner separated and carried by the toner supporting member 25 is conveyed by that toner supporting member 25 and develops the electrostatic latent image on the image bearer 1 in the development area 6, and the opposite polarity particles separated due to the toner separation bias are conveyed to the developer tank 16 by the developer supporting member 11, and are accumulated in the developer tank 16. Due to this accumulation of the opposite polarity particles in the developer tank 16, using the charging due to friction with the opposite polarity particles it is possible to compensate for the reduction in the amount of charge on the toner caused by carrier deterioration due to repeated printing. At this time, it is desirable that the electric field intensity in the closest part in the opposing portion between the toner supporting member 25 and the developer supporting member 11 in the direction of supplying the toner from the developer supporting member 11 to the toner supporting member 11 is in the range of $2.5\times10^6$ V/m to $6\times10^6$ V/m. If the electric field intensity is smaller than $2.5\times10^6$ V/m, the opposite polarity particles are not sufficiently recovered by the developer supporting member 11 but get transferred to the toner supporting member 25, and hence it will not be possible to compensate for the carrier deterioration due to continuous printing. Also, if the electric field intensity is more than $6\times10^6$ V/m, a partial dielectric breakdown occurs between the toner supporting member 25 and the developer supporting member 11 making it difficult to carry out toner supply and recovery sufficiently, and memory images will appear in the printed images.

In such a developer that includes opposite polarity particles, in addition to the conditions given in the previous preferred embodiment, by making the electric field intensity in the direction of supplying the toner to the toner supporting member 11 to be in the range of $2.5\times10^6$ V/m to $6\times10^6$ V/m, it is possible to return efficiently the opposite polarity particles to the developer tank 16, and it is possible to maintain for a long time stable images without being affected by carrier deterioration associated with continuous printing.

Figure 2:
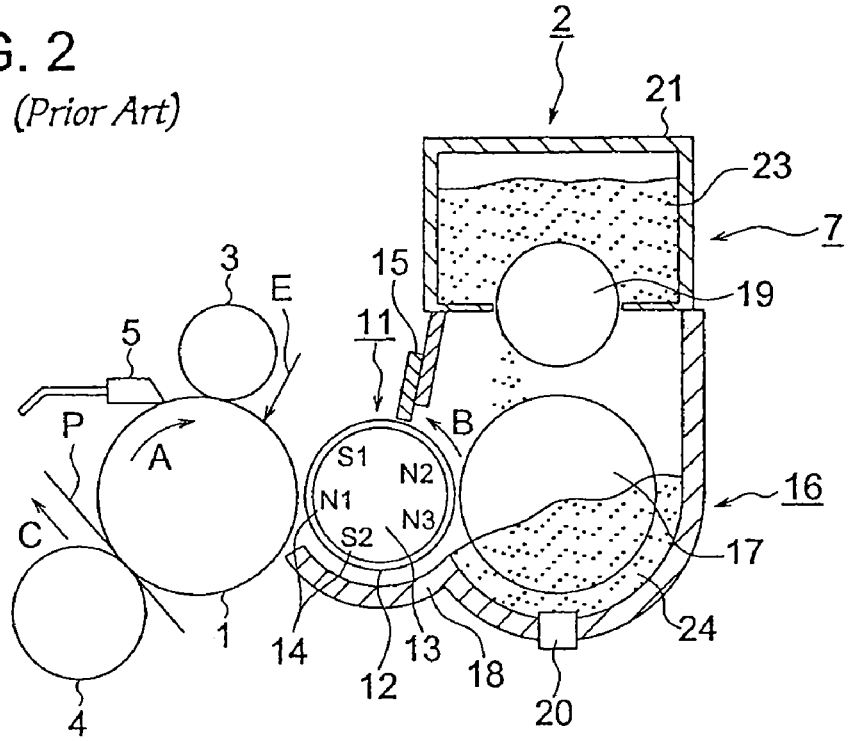
FIG. 2 (Prior Art)
FIG. 2 shows an outline configuration diagram of the essential part of a conventional image forming apparatus.

Further, in a two-component development apparatus of the conventional configuration shown in FIG. 2, if opposite polarity particles are added to the developer, although the toner is consumed in the image part of the image bearer 1, the opposite polarity particles are consumed in the non-image part. This is because the electric fields in the image part and in the non-image part are formed in opposite directions because a bias voltage Vb (not shown in the figure) is applied to the developer supporting member 11. Therefore, depending on the image area ratio, the balance between the rates of consumption of the toner and the opposite polarity particles does not become stable, particularly when images with large non-image areas are printed in large quantities, the opposite polarity particles in the developer are preferentially consumed, it will not be possible to correct the carrier charging property, and the effect of suppressing carrier deterioration gets reduced. Because of this, it can be said that the effect of suppressing carrier deterioration has been fully displayed in the preferred embodiment using the hybrid development method.

<Opposite Polarity Particles>

The opposite polarity particles that are used are selected appropriately depending on the charging polarity of the toner. When a negatively charging toner is used, fine particles that are charged positive are used as the opposite polarity particles. For example, it is possible to use inorganic particles such as strontium titanate, barium titanate, alumina, etc., or to use particles made of thermoplastic resins or thermosetting resins such as acrylic resin, benzoguanamine resin, nylon resin, polyimide resin, polyamide resin, etc., also, it is possible to include in the resin some positive charging control agents that apply positive charge, or it is possible to configure nitrogen containing copolymers. Here, as the positive charging control agent, it is possible to use, for example, nigrosine dye, quaternary ammonium salts, etc., and also, as the above nitrogen containing monomer, it is possible to use 2-dimethyl amino ethyl acrylate, 2-diethyl amino ethyl acrylate, 2-dimethyl amino ethyl methacrylate, 2-diethyl amino ethyl methacrylate, vinyl pyridine, N-vinyl carbazole, vinyl imidazole, etc.

On the other hand, when a positively charging toner is being used, fine particles that are charged negatively are used as the opposite polarity particles. For example, not only inorganic particles such as silica, titanium dioxide, etc., but also fine particles constituted from thermosetting resins or thermoplastic resins such as resins containing fluorine, polyolefin resins, silicone resins, polyester resins, etc., or else can be used, it is also possible to include in the resins a negatively charging control agent that gives negative charging property, or to form copolymers of acrylic type monomers containing fluorine, or methacrylate type monomers containing fluorine. Here, as the above negatively charging control agent, it is possible to use, for example, salicylate types, naphthol type chrome complex, aluminum complex, iron complex, zinc complex, etc.

Although the diameters of the opposite polarity particles are not restricted, it is desirable that the number average particle diameter of the opposite polarity particles is in the range of 100 to 1000 nm.

Further, in order to control the charging property and the hydrophobicity of opposite polarity particles, it is also possible to carry out surface treatment of the surface of the inorganic fine particles using a silane coupling agent, a titanium coupling agent, silicone oil, etc., and in particular, when giving positive charging property to the inorganic fine particles, it is desirable to carry out surface treatment with a coupling agent having an amino radical, or when giving negative charging property, it is desirable to carry out surface treatment using a coupling agent having a fluorine radical.

Further, it is desirable to use high hardness inorganic fine particles because it is possible to expect the effect of polishing and removing the fine powder component of the toner or the external additives that have got adhered to the surface of the carrier.

By including opposite polarity particles in a two-component developer, suppressing the consumption of opposite polarity particles in the image bearer side, and by accumulating the opposite polarity particles in the developer due to long use, it is possible, even if the charge bearing property of the carrier gets reduced due to spent matter of toner or post processing agent on the carrier, to compensate for the charge bearing property of the carrier effectively because even the opposite polarity particles can charge the toner with the proper polarity, and as a result, it is possible to suppress the deterioration of the carrier.

Figure 3:
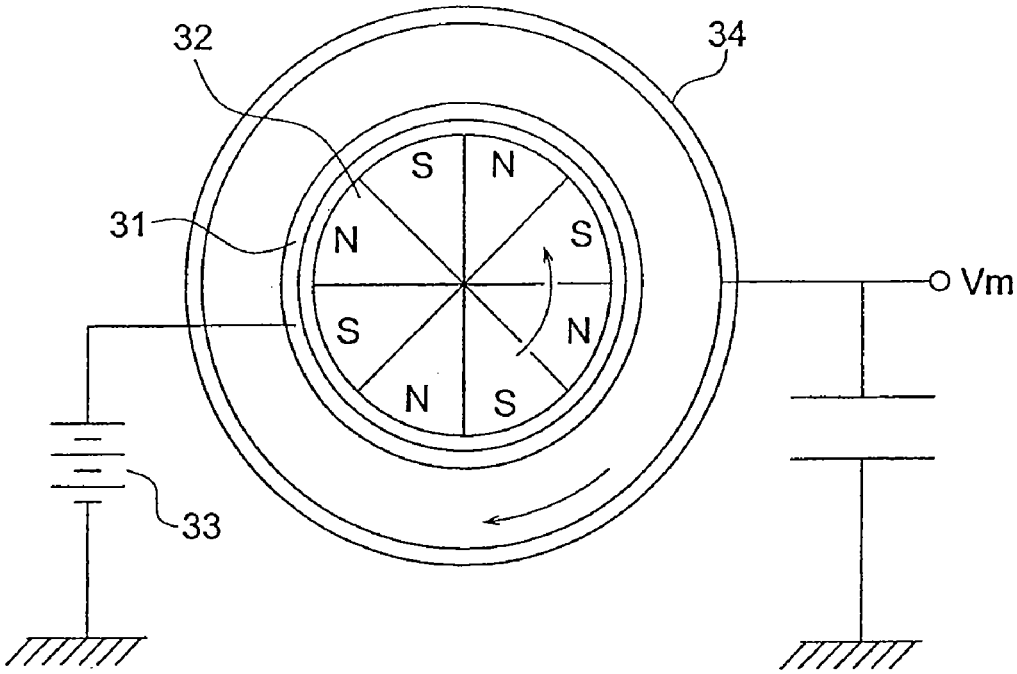
FIG. 3 shows an outline configuration diagram of a charge amount measurement apparatus.

The charging property of the opposite polarity particles and toner due to the combination of the opposite polarity particles, the toner, and the carrier can be found easily from the direction of the electric field for separating the toner or the opposite polarity particles from the developer using the apparatus of FIG. 3 after they have been mixed and stirred to prepare the developer.

In other words, in the apparatus shown in FIG. 3, the developer made of the toner, the carrier, and the opposite polarity particles is placed uniformly over the entire surface of the conductive sleeve 31 and also the rotational speed of the magnet roller 32 provided inside this conductive sleeve 31 is set at 1000 rpm, a bias voltage of 2 kV from the bias power supply 33 is applied with a polarity opposite to the polarity of charging of the toner, the above conductive sleeve 31 is rotated for 15 seconds, and after this conductive sleeve 31 is stopped, by reading out the potential Vm on the cylindrical electrode 34 and by weighing the mass of the toner that has got adhered to the cylindrical electrode 34 precisely using a precision balance, it is possible to obtain the amount of charge on the toner.

Further, the polarity of the added particles other than the toner and the carrier can be judged from the polarity of the bias voltage applied from the bias power supply 33. In other words, when the bias voltage from the bias power supply 33 is applied with a polarity opposite to the polarity of charging of the toner, the particles adhered to the cylindrical electrode 34 have a polarity opposite to the charging polarity of the toner, that is, they are opposite polarity particles.

Although the quantity of opposite polarity particles contained in the initial developer is not particularly restricted as long as the purpose of the present invention is achieved, it is desirable that it is, for example, 0.01 to 5% by mass relative to the carrier mass.

As the replenishment toner 23, it is desirable to use a toner with the opposite polarity particles added as external additives. By using a toner to which external addition of opposite polarity particles has been added, it is possible to effectively compensate the reduction in the charge bearing property of the carrier that deteriorates gradually due to long use. The amount of external addition of opposite polarity particles in the replenishment toner 23 should desirably be in the range of 0.1 to 10.0% by mass with respect to the toner, and particularly desirably be in the range of 0.5 to 5.0% by mass.

According to the present preferred embodiment, in a development apparatus of the method of developing a latent image by forming a toner thin layer on the toner supporting member using a magnetic brush on the developer supporting member, by making the surfaces of the toner supporting member and the developer supporting member move in opposite directions at the part where they are opposite each other, by giving an electric field with a prescribed strength at the closest part between them in a direction so as to recover the toner from the toner supporting member to the developer supporting member, and also, by making the developer present with an appropriate ratio of presence in the closest part of the opposing space, it is possible to provide a development apparatus and an image forming apparatus that can control in a stable manner and over a long time the reduction in the development performance such as density reduction, etc., that are caused by the toner remaining on the toner supporting member and to suppress a part of the previously developed image appearing as a residual image (ghost image) in the next image development, without providing a toner peeling off member that presses against and comes into contact with the toner supporting member, by recovering sufficiently the residual toner after development on the toner supporting member using a magnetic brush, and by preventing the accumulation of the residual toner on the toner supporting member, and by promoting the replacement with new toner.

EXAMPLES

(1) Development Apparatus and Setting Conditions

Using a development apparatus shown in FIG. 1, a rectangular wave development bias voltage having amplitude of 1.6 kV, DC component of −400 V, duty ratio of 35%, and a frequency of 2 kHz was applied to the toner supporting member. The bias applied to the developer supporting member had the same duty ratio as the development bias voltage applied to the toner supporting member but its amplitude and DC component were varied so that its average potential was maintained to have a potential difference of −100 V with respect to the average potential −160 V of the development bias.

An aluminum roller with alumite treatment given on its surface was used as the toner supporting member, and the gap at the nearest point with the developer supporting member was varied from 0.2 to 0.5 mm. The potential of the background part of the electrostatic latent image formed on the image bearer was −550 V and the image part potential was −60 V. The gap at the closest point between the image bearer and the toner supporting member was set to be 0.15 mm.

Experimental Example 1

The following carrier and toner were used as the developer.

Carrier: This was a coated type carrier with a silicone resin coated on the carrier core particles made of a magnetic material, and a carrier with an average particle diameter of 33 μm for the bizhub C350 manufactured by Konica-Minolta Business Technologies Co. Ltd., was used.

Toner: A negative polarity toner A was obtained by carrying out external addition processing for 100 parts by mass of a toner base material with a particle diameter of about 6.5 μm manufactured by the wet type particle manufacturing method, subjecting this base material to which 0.2 part by mass of a first hydrophobic silica, 0.5 part by mass of a second hydrophobic silica, and 0.5 part by mass of hydrophobic titanium dioxide were added to surface treatment using a Henschel mixer (manufactured by Mitsui Metal Mining Corp) for 3 minutes at a speed of 40 m/s.

The first hydrophobic silica used here was silica with an average primary particle diameter of 16 nm (#130: manufactured by Nihon Aerosil Co. Ltd.,) to which surface treatment was made using hexamethyldisilazane (HMDS) which is a hydrophobizing agent. Further, the second hydrophobic silica used here was silica with an average primary particle diameter of 20 nm (#90G: manufactured by Nihon Aerosil Co., Ltd.) to which surface treatment was made using HMDS. The hydrophobic titanium dioxide used here was anatase type titanium dioxide with an average primary particle diameter of 30 nm to which surface treatment was made in an aqueous wet atmosphere using isobutyltrimethoxysilane which is a hydrophobizing agent.

The bizhub C350 manufactured by Konica-Minolta Business Technologies Co. Ltd., was used as the image forming apparatus. As the evaluation method, an image pattern having a solid region and a half region as shown in FIGS. 4(*a*) and 4(*b*) was output, and the image density and generation of memory were observed visually. In addition, from the carrier adhesion of horizontal stripes and the noise due to contamination of carrier in the image, the clogging of the developer was considered to occur in the opposing portion between the toner supporting member and the developer supporting member. The relationship between this noise and clogging was verified by observing the interior of the development apparatus after the noise was generated. In addition, even the noise of the carrier getting adhered over the entire transfer sheet was observed visually. This is the noise generated when the voltage in the direction of recovering the toner from the toner supporting member to the developer supporting member becomes large and is caused by the carrier on the developer supporting member getting separated from the magnetic force inside the developer supporting member and getting transferred onto the toner supporting member.

The voltage application conditions and the evaluation results of the toner supporting member and the developer supporting member of the development apparatus used in the experiments are shown in Tables 1 to Table 8. The meanings of the symbols and the terms used in these tables are explained below.

Development: The condition of the voltage applied to the toner supporting member for developing the image bearer.

Supply: The condition of the voltage applied to the developer supporting member that supplies toner to the toner supporting member.

Dss: The closest gap between the toner supporting member and the developer supporting member.

Vpp: The amplitude of the AC component of the development bias voltage applied to the toner supporting member.

Vdc: The DC component of the development bias voltage.

Duty: The duty ratio of the AC component of the development bias voltage. (Indicates the duty ratio when the electric field is being applied that moves the toner from the toner supporting member to the image bearer.)

Vave: The average bias voltage value of the development bias voltage.

Vsave: The average bias voltage applied to the developer supporting member.

Vspp: The amplitude of the AC component of the bias voltage applied to the developer supporting member. [A minus (−) in the table indicates that the phase is opposite (see FIG. 5(*a*) and FIG. 5(*b*)).]

Vsdc: The DC component of the bias voltage applied to the developer supporting member.

Vsmax: The maximum potential of the AC component of the bias voltage applied to the developer supporting member.

Vsmin: The minimum potential of the AC component of the bias voltage applied to the developer supporting member.

Supply potential difference: The potential difference at the time the toner moves from the developer supporting member to the toner supporting member.

Recovery potential difference: The potential difference at the time the toner moves from the toner supporting member to the developer supporting member.

Supply electric field: The electric field (=supply potential difference/Dss) at the time the toner moves from the developer supporting member to the toner supporting member.

Recovery electric field: The electric field (=recovery potential difference/Dss) at the time the toner moves from the toner supporting member to the developer supporting member.

MS: The amount of developer on the developer supporting member.

PD: The share of the developer in the gap between the toner supporting member and the developer supporting member.

B: Image density and memory are both good.

C: Although the image density is good, memory has been generated.

D: Image density is low and memory also has been generated.

Carrier adhesion: Carrier has got adhered to the entire transfer sheet.

TABLE 1

| Expt No. | Dss (mm) | Development F2khz Vpp (V) | Vdc (V) | Duty (%) | Vave (V) | Supply Vsave (V) | Vspp (V) | Vsdc (V) | Vsmax (V) | Vsmin (V) | *1 | Supply, recovery electric field conditions: Recovery potential difference (V) | Supply electric field (V/m) | Recovery electric field (V/m) |
|---|---|---|---|---|---|---|---|---|---|---|---|---|---|---|
| 1-1 | 0.2 | 1600 | −400 | 35 | −160 | −260 | 1200 | −440 | 160 | −1040 | 240 | 160 | 1.20E+06 | 8.00E+05 |
| 1-2 | 0.2 | 1600 | −400 | 35 | −160 | −260 | 1000 | −410 | 90 | −910 | 310 | 290 | 1.55E+06 | 1.45E+06 |
| 1-3 | 0.2 | 1600 | −400 | 35 | −160 | −260 | 800 | −380 | 20 | −780 | 380 | 420 | 1.90E+06 | 2.10E+06 |
| 1-4 | 0.2 | 1600 | −400 | 35 | −160 | −260 | 700 | −365 | −15 | −715 | 415 | 485 | 2.08E+06 | 2.43E+06 |
| 1-5 | 0.2 | 1600 | −400 | 35 | −160 | −260 | 600 | −350 | −50 | −650 | 450 | 550 | 2.25E+06 | 2.75E+06 |
| 1-6 | 0.2 | 1600 | −400 | 35 | −160 | −260 | 500 | −335 | −85 | −585 | 485 | 615 | 2.43E+06 | 3.08E+06 |
| 1-7 | 0.2 | 1600 | −400 | 35 | −160 | −260 | 400 | −320 | −120 | −520 | 520 | 680 | 2.60E+06 | 3.40E+06 |
| 1-8 | 0.2 | 1600 | −400 | 35 | −160 | −260 | 200 | −290 | −190 | −390 | 590 | 810 | 2.95E+06 | 4.05E+06 |
| 1-9 | 0.2 | 1600 | −400 | 35 | −160 | −260 | 0 | −260 | −260 | −260 | 660 | 940 | 3.30E+06 | 4.70E+06 |
| 1-10 | 0.2 | 1600 | −400 | 35 | −160 | −260 | −200 | −230 | −330 | −130 | 730 | 1070 | 3.65E+06 | 5.35E+06 |

*1: Supply potential difference (V)

TABLE 2

| Expt No. | Evaluation result Top row: MS (g/m$^2$), bottom row: PD 70 8.8% | 75 9.5% | 85 10.7% | 100 12.6% | 110 13.9% |
|---|---|---|---|---|---|
| 1-1 | D | D | D | D | Clogging |
| 1-2 | D | D | D | D | Clogging |
| 1-3 | D | D | D | D | Clogging |
| 1-4 | C | C | C | C | Clogging |
| 1-5 | C | B | B | B | Clogging |
| 1-6 | C | B | B | B | Clogging |

TABLE 2-continued

| Expt No. | Evaluation result Top row: MS (g/m$^2$), bottom row: PD 70 8.8% | 75 9.5% | 85 10.7% | 100 12.6% | 110 13.9% |
|---|---|---|---|---|---|
| 1-7 | C | B | B | B | Clogging |
| 1-8 | C | B | B | B | Clogging |
| 1-9 | C | B | B | B | Clogging |
| 1-10 | Carrier adhesion | | | | |

TABLE 3

| Expt No. | Dss (mm) | Development F2khz Vpp (V) | Vdc (V) | Duty (%) | Vave (V) | Supply Vsave (V) | Vspp (V) | Vsdc (V) | Vsmax (V) | Vsmin (V) | *1 | Supply, recovery electric field conditions: Recovery potential difference (V) | Supply electric field (V/m) | Recovery electric field (V/m) |
|---|---|---|---|---|---|---|---|---|---|---|---|---|---|---|
| 1-11 | 0.3 | 1600 | −400 | 35 | −160 | −260 | 500 | −335 | −85 | −585 | 485 | 615 | 1.62E+06 | 2.05E+06 |
| 1-12 | 0.3 | 1600 | −400 | 35 | −160 | −260 | 400 | −320 | −120 | −520 | 520 | 680 | 1.73E+06 | 2.27E+06 |
| 1-13 | 0.3 | 1600 | −400 | 35 | −160 | −260 | 300 | −305 | −155 | −455 | 555 | 745 | 1.85E+06 | 2.48E+06 |
| 1-14 | 0.3 | 1600 | −400 | 35 | −160 | −260 | 200 | −290 | −190 | −390 | 590 | 810 | 1.97E+06 | 2.70E+06 |
| 1-15 | 0.3 | 1600 | −400 | 35 | −160 | −260 | 0 | −260 | −260 | −260 | 660 | 940 | 2.20E+06 | 3.13E+06 |
| 1-16 | 0.3 | 1600 | −400 | 35 | −160 | −260 | −200 | −230 | −330 | −130 | 730 | 1070 | 2.43E+06 | 3.57E+06 |
| 1-17 | 0.3 | 1600 | −400 | 35 | −160 | −260 | −400 | −200 | −400 | 0 | 800 | 1200 | 2.67E+06 | 4.00E+06 |
| 1-18 | 0.3 | 1600 | −400 | 35 | −160 | −260 | −600 | −170 | −470 | 130 | 870 | 1330 | 2.90E+06 | 4.43E+06 |
| 1-19 | 0.3 | 1600 | −400 | 35 | −160 | −260 | −800 | −140 | −540 | 260 | 940 | 1460 | 3.13E+06 | 4.87E+06 |
| 1-20 | 0.3 | 1600 | −400 | 35 | −160 | −260 | −1000 | −110 | −610 | 390 | 1010 | 1590 | 3.37E+06 | 5.30E+06 |

*1: Supply potential difference (V)

TABLE 4

| Expt No. | Evaluation result Top row: MS (g/m$^2$), bottom row: PD 100 8.4% | 110 9.3% | 180 15.2% | 230 19.4% | 240 20.2% |
|---|---|---|---|---|---|
| 1-11 | D | D | D | D | Clogging |
| 1-12 | D | D | D | D | Clogging |
| 1-13 | D | C | C | C | Clogging |
| 1-14 | C | B | B | B | Clogging |
| 1-15 | C | B | B | B | Clogging |
| 1-16 | C | B | B | B | Clogging |

TABLE 4-continued

| Expt No. | Evaluation result Top row: MS (g/m$^2$), bottom row: PD 100 8.4% | 110 9.3% | 180 15.2% | 230 19.4% | 240 20.2% |
|---|---|---|---|---|---|
| 1-17 | C | B | B | B | Clogging |
| 1-18 | C | B | B | B | Clogging |
| 1-19 | C | B | B | B | Clogging |
| 1-20 | Carrier adhesion | | | | |

TABLE 5

| Expt No. | Dss (mm) | Development F2khz Vpp (V) | Vdc (V) | Duty (%) | Vave (V) | Supply Vsave (V) | Vspp (V) | Vsdc (V) | Vsmax (V) | Vsmin (V) | Supply, recovery electric field conditions *1 | Recovery potential difference (V) | Supply electric field (V/m) | Recovery electric field (V/m) |
|---|---|---|---|---|---|---|---|---|---|---|---|---|---|---|
| 1-21 | 0.4 | 1600 | −400 | 35 | −160 | −260 | 200 | −290 | −190 | −390 | 590 | 810 | 1.48E+06 | 2.03E+06 |
| 1-22 | 0.4 | 1600 | −400 | 35 | −160 | −260 | 0 | −260 | −260 | −260 | 660 | 940 | 1.65E+06 | 2.35E+06 |
| 1-23 | 0.4 | 1600 | −400 | 35 | −160 | −260 | −200 | −230 | −330 | −130 | 730 | 1070 | 1.83E+06 | 2.68E+06 |
| 1-24 | 0.4 | 1600 | −400 | 35 | −160 | −260 | −400 | −200 | −400 | 0 | 800 | 1200 | 2.00E+06 | 3.00E+06 |
| 1-25 | 0.4 | 1600 | −400 | 35 | −160 | −260 | −600 | −170 | −470 | 130 | 870 | 1330 | 2.18E+06 | 3.33E+06 |
| 1-26 | 0.4 | 1600 | −400 | 35 | −160 | −260 | −800 | −140 | −540 | 260 | 940 | 1460 | 2.35E+06 | 3.65E+06 |
| 1-27 | 0.4 | 1600 | −400 | 35 | −160 | −260 | −1000 | −110 | −610 | 390 | 1010 | 1590 | 2.53E+06 | 3.98E+06 |
| 1-28 | 0.4 | 1600 | −400 | 35 | −160 | −260 | −1200 | −80 | −680 | 520 | 1080 | 1720 | 2.70E+06 | 4.30E+06 |
| 1-29 | 0.4 | 1600 | −400 | 35 | −160 | −260 | −1400 | −50 | −750 | 650 | 1150 | 1850 | 2.88E+06 | 4.63E+06 |
| 1-30 | 0.4 | 1600 | −400 | 35 | −160 | −260 | −1600 | −20 | −820 | 810 | 1220 | 2010 | 3.05E+06 | 5.03E+06 |

*1: Supply potential difference (V)

TABLE 6

| Expt No. | Evaluation result Top row: MS (g/m$^2$), bottom row: PD 140 8.8% | 150 9.5% | 200 12.6% | 300 19.0% | 400 25.3% | 420 26.5% |
|---|---|---|---|---|---|---|
| 1-21 | D | D | D | D | D | Clogging |
| 1-22 | D | C | C | C | C | Clogging |
| 1-23 | D | B | B | B | B | Clogging |
| 1-24 | C | B | B | B | B | Clogging |
| 1-25 | C | B | B | B | B | Clogging |
| 1-26 | C | B | B | B | B | Clogging |
| 1-27 | C | B | B | B | B | Clogging |
| 1-28 | C | B | B | B | B | Clogging |
| 1-29 | C | B | B | B | B | Clogging |
| 1-30 | Carrier adhesion | | | | | |

TABLE 7

| Expt No. | Dss (mm) | Development F2khz Vpp (V) | Vdc (V) | Duty (%) | Vave (V) | Supply Vsave (V) | Vspp (V) | Vsdc (V) | Vsmax (V) | Vsmin (V) | Supply, recovery electric field conditions *1 | Recovery potential difference (V) | Supply electric field (V/m) | Recovery electric field (V/m) |
|---|---|---|---|---|---|---|---|---|---|---|---|---|---|---|
| 1-31 | 0.5 | 1600 | −400 | 35 | −160 | −260 | 0 | −260 | −260 | −260 | 660 | 940 | 1.32E+06 | 1.88E+06 |
| 1-32 | 0.5 | 1600 | −400 | 35 | −160 | −260 | −300 | −215 | −365 | −65 | 765 | 1135 | 1.53E+06 | 2.27E+06 |
| 1-33 | 0.5 | 1600 | −400 | 35 | −160 | −260 | −500 | −185 | −435 | 65 | 835 | 1265 | 1.67E+06 | 2.53E+06 |

TABLE 7-continued

| | | Development F2khz | | | | Supply | | | | | | Supply, recovery electric field conditions | | |
|---|---|---|---|---|---|---|---|---|---|---|---|---|---|---|
| Expt No. | Dss (mm) | Vpp (V) | Vdc (V) | Duty (%) | Vave (V) | Vsave (V) | Vspp (V) | Vsdc (V) | Vsmax (V) | Vsmin (V) | *1 | Recovery potential difference (V) | Supply electric field (V/m) | Recovery electric field (V/m) |
| 1-34 | 0.5 | 1600 | −400 | 35 | −160 | −260 | −800 | −140 | −540 | 260 | 940 | 1460 | 1.88E+06 | 2.92E+06 |
| 1-35 | 0.5 | 1600 | −400 | 35 | −160 | −260 | −1000 | −110 | −610 | 390 | 1010 | 1590 | 2.02E+06 | 3.18E+06 |
| 1-36 | 0.5 | 1600 | −400 | 35 | −160 | −260 | −1200 | −80 | −680 | 520 | 1080 | 1720 | 2.16E+06 | 3.44E+06 |
| 1-37 | 0.5 | 1600 | −400 | 35 | −160 | −260 | −1500 | −35 | −785 | 715 | 1185 | 1915 | 2.37E+06 | 3.83E+06 |
| 1-38 | 0.5 | 1600 | −400 | 35 | −160 | −260 | −2000 | 40 | −960 | 1040 | 1360 | 2240 | 2.72E+06 | 4.48E+06 |
| 1-39 | 0.5 | 1600 | −400 | 35 | −160 | −260 | −2200 | 70 | −1030 | 1170 | 1430 | 2370 | 2.86E+06 | 4.74E+06 |
| 1-40 | 0.5 | 1600 | −400 | 35 | −160 | −260 | −2500 | 115 | −1135 | 1365 | 1535 | 2565 | 3.07E+06 | 5.13E+06 |

*1: Supply potential difference (V)

TABLE 8

| | Evaluation result Top row: MS (g/m$^2$), bottom row: PD | | | | | |
|---|---|---|---|---|---|---|
| Expt No. | 170 8.6% | 200 10.1% | 300 15.2% | 400 20.2% | 600 30.3% | 650 26.5% |
| 1-31 | D | D | D | D | D | Clogging |
| 1-32 | D | C | C | C | C | Clogging |
| 1-33 | D | B | B | B | B | Clogging |
| 1-34 | C | B | B | B | B | Clogging |
| 1-35 | C | B | B | B | B | Clogging |
| 1-36 | C | B | B | B | B | Clogging |
| 1-37 | C | B | B | B | B | Clogging |
| 1-38 | C | B | B | B | B | Clogging |
| 1-39 | C | B | B | B | B | Clogging |
| 1-40 | Carrier adhesion | | | | | |

From the results shown in Tables 1 to Table 8, the memory phenomenon suppression was good when the recovery electric field was in range of $2.5\times10^6$ V/m to $5\times10^6$ V/m. When the electric field was less than $2.5\times10^6$ V/m, the recovery of the toner from the toner supporting member was insufficient and memory phenomenon occurred. Also, when the electric field was larger than $5\times10^6$ V/m, carrier adhesion occurred because the carrier on the developer supporting member got transferred to the toner supporting member.

Figure 6:
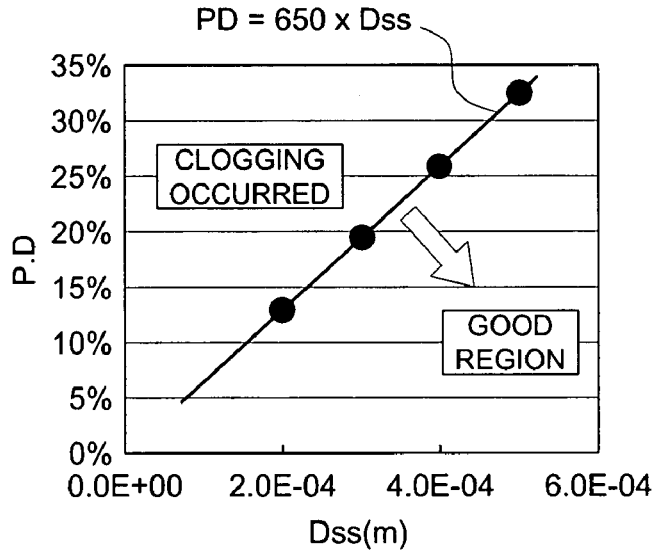
FIG. 6 shows the relationship between the ratio of presence and clogging of the developer between the toner supporting member and the developer supporting member.

Furthermore, it was necessary that the share of the developer in the gap between the toner supporting member and the developer supporting member (PD: the packing density) is 9% or more. In addition, the upper limit of this is determined by clogging of the developer, and clogging occurred when the amount of developer conveyed was more than 100 g/m$^2$ on the developer supporting member when Dss was 0.2 mm, and the excess carrier was conveyed along with the rotation of the toner supporting member and got adhered to the image bearer resulting in image noise. In a similar manner, clogging occurred at 230 g/m$^2$ or more when Dss was 0.3 mm, at 410 g/m$^2$ or more when Dss was 0.4, and at 640 g/m$^2$ or more when Dss was 0.5 mm. In addition, when Dss was less than 0.2 mm, it was necessary to control strictly the accuracy of the fluctuation of rotations of the toner supporting member and the developer supporting member, and this invites cost increase. Furthermore, when Dss was more than 0.5 mm, the bias required for forming the electric field necessary to carry out supply and recovery of the toner becomes higher inviting increased cost of the power supply, etc. This result is shown in FIG. 6. From this result it is clear that the upper limit of PD at which there is no occurrence of clogging is determined by the following relationship when Dss is in the range from 0.2 mm to 0.5 mm.

PD=650×Dss (Dss: The closest gap between the toner supporting member and the developer supporting member. (m))

Here, PD is the share of the developer in the gap between the toner supporting member and the developer supporting member, and is calculated according to the following equation.

$$PD=M/\rho Dss\rho=\rho t\times TC+\rho c\times(1-TC)$$

Here, M is the quantity of developer, ρ is the density of the developer, ρt is the density of the toner, ρc is the density of the carrier, and TC is the toner density in the developer.

In this manner, it is clear that good images can be obtained when PD satisfies the relationship of $0.09\leqq PD\leqq 650\times Dss$ when the electric field is in the range from $2.5\times10^6$ V/m to $5\times10^6$ V/m.

Experimental Example 2

A negative polarity toner was obtained by adding to the toner used in Experimental Example 12 parts by mass of hydrophobic strontium titanate with a number average particle diameter of 300 nm as the opposite polarity particle with respect to 100 parts by mass of the base particle of the toner, and carrying out external additive addition treatment for three minutes at a speed of 40 m/s using a Henschel mixer.

The same development apparatus and image forming apparatus as those used in the Experimental Example 1 above were also used here, 50,000 sheets of A4 size were printed out using an image with a B/W ratio of 5% with the sheets fed laterally, and then the amount of charge on the toner in the developer in the developer tank 16 was measured using an apparatus shown in FIG. 3, and this was compared with the initial amount of charge, thereby was evaluated by the amount of its reduction. In addition, at the same time, the evaluation of images after printing out 50,000 sheets was also made in a manner similar to that used in Experimental Example 1 above.

The voltage application conditions and the evaluation results of the toner supporting member and the developer supporting member of the development apparatus used in the experiments are shown in Tables 9 to Table 16. The meanings of the symbols and the terms used in these tables are the same as those explained in Experimental Example 1 above. Further, the evaluation results of reduction in the amount of toner charge are indicated by the following symbols:

A: 3 μC/g or less, B: More than 3 μC/g but less than 5 μC/g, C: More than 5 μC/g but less than 10 μC/g, D: More than 10 μC/g

TABLE 9

| Expt No. | Dss (mm) | Development F2khz Vpp (V) | Vdc (V) | Duty (%) | Vave (V) | Supply Vsave (V) | Vspp (V) | Vsdc (V) | Vsmax (V) | Vsmin (V) | *1 | Supply, recovery electric field conditions: Recovery potential difference (V) | Supply electric field (V/m) | Recovery electric field (V/m) |
|---|---|---|---|---|---|---|---|---|---|---|---|---|---|---|
| 2-1 | 0.2 | 1600 | −400 | 35 | −160 | −260 | 600 | −350 | −50 | −650 | 450 | 550 | 2.25E+06 | 2.75E+06 |
| 2-2 | 0.2 | 1600 | −400 | 35 | −160 | −260 | 500 | −335 | −85 | −585 | 485 | 615 | 2.43E+06 | 3.08E+06 |
| 2-3 | 0.2 | 1600 | −400 | 35 | −160 | −260 | 400 | −320 | −120 | −520 | 520 | 680 | 2.60E+06 | 3.40E+06 |
| 2-4 | 0.2 | 1600 | −400 | 35 | −160 | −260 | 200 | −290 | −190 | −390 | 590 | 810 | 2.95E+06 | 4.05E+06 |
| 2-5 | 0.2 | 1600 | −400 | 35 | −160 | −260 | 0 | −260 | −260 | −260 | 660 | 940 | 3.30E+06 | 4.70E+06 |

*1: Supply potential difference (V)

TABLE 10

| Expt No. | Dss (mm) | Charging amount reduction evaluation result Top row: MS (g/m$^2$), bottom row: PD: 75 9.5% | | 85 10.7% | | 100 12.6% | | Image evaluation result Top row: MS (g/m$^2$), bottom row: PD: 75 9.50% | 85 10.70% | 100 12.60% |
|---|---|---|---|---|---|---|---|---|---|---|
| 2-1 | 0.2 | C | 5.5 | B | 4.8 | B | 4.3 | B | B | B |
| 2-2 | 0.2 | B | 4.2 | B | 3.5 | B | 3.6 | B | B | B |
| 2-3 | 0.2 | A | 2.5 | A | 2.2 | A | 2.7 | B | B | B |
| 2-4 | 0.2 | A | 2.8 | A | 2.8 | A | 3.0 | B | B | B |
| 2-5 | 0.2 | A | 2.4 | A | 3.0 | A | 2.1 | B | B | B |

TABLE 11

| Expt No. | Dss (mm) | Development F2khz Vpp (V) | Vdc (V) | Duty (%) | Vave (V) | Supply Vsave (V) | Vspp (V) | Vsdc (V) | Vsmax (V) | Vsmin (V) | *1 | Supply, recovery electric field conditions: Recovery potential difference (V) | Supply electric field (V/m) | Recovery electric field (V/m) |
|---|---|---|---|---|---|---|---|---|---|---|---|---|---|---|
| 2-6 | 0.3 | 1600 | −400 | 35 | −160 | −260 | 200 | −290 | −190 | −390 | 590 | 810 | 1.97E+06 | 2.70E+06 |
| 2-7 | 0.3 | 1600 | −400 | 35 | −160 | −260 | 0 | −260 | −260 | −260 | 660 | 940 | 2.20E+06 | 3.13E+06 |
| 2-8 | 0.3 | 1600 | −400 | 35 | −160 | −260 | −200 | −230 | −330 | −130 | 730 | 1070 | 2.43E+06 | 3.57E+06 |
| 2-9 | 0.3 | 1600 | −400 | 35 | −160 | −260 | −400 | −200 | −400 | 0 | 800 | 1200 | 2.67E+06 | 4.00E+06 |
| 2-10 | 0.3 | 1600 | −400 | 35 | −160 | −260 | −600 | −170 | −470 | 130 | 870 | 1330 | 2.90E+06 | 4.43E+06 |
| 2-11 | 0.3 | 1600 | −400 | 35 | −160 | −260 | −800 | −140 | −540 | 260 | 940 | 1460 | 3.13E+06 | 4.87E+06 |

*1: Supply potential difference (V)

TABLE 12

| Expt No. | Dss (mm) | Charging amount reduction evaluation result Top row: MS (g/m$^2$), bottom row: PD: 110 9.5% | | 180 15.2% | | 230 19.4% | | Image evaluation result Top row: MS (g/m$^2$), bottom row: PD: 110 9.3% | 180 15.2% | 230 19.4% |
|---|---|---|---|---|---|---|---|---|---|---|
| 2-6 | 0.3 | C | 6.3 | C | 5.5 | B | 4.5 | B | B | B |
| 2-7 | 0.3 | C | 5.1 | B | 4.8 | B | 3.8 | B | B | B |
| 2-8 | 0.3 | B | 4.2 | B | 3.4 | B | 3.5 | B | B | B |
| 2-9 | 0.3 | A | 2.9 | A | 2.8 | A | 2.9 | B | B | B |
| 2-10 | 0.3 | A | 2.5 | A | 2.3 | A | 2.3 | B | B | B |
| 2-11 | 0.3 | A | 2.6 | A | 1.8 | A | 1.5 | B | B | B |

TABLE 13

| | | Development F2khz | | | | Supply | | | | | Supply, recovery electric field conditions | | | |
|---|---|---|---|---|---|---|---|---|---|---|---|---|---|---|
| Expt No. | Dss (mm) | Vpp (V) | Vdc (V) | Duty (%) | Vave (V) | Vsave (V) | Vspp (V) | Vsdc (V) | Vsmax (V) | Vsmin (V) | *1 | Recovery potential difference (V) | Supply electric field (V/m) | Recovery electric field (V/m) |
| 2-12 | 0.4 | 1600 | −400 | 35 | −160 | −260 | −200 | −230 | −330 | −130 | 730 | 1070 | 1.83E+06 | 2.68E+06 |
| 2-13 | 0.4 | 1600 | −400 | 35 | −160 | −260 | −400 | −200 | −400 | 0 | 800 | 1200 | 2.00E+06 | 3.00E+06 |
| 2-14 | 0.4 | 1600 | −400 | 35 | −160 | −260 | −600 | −170 | −470 | 130 | 870 | 1330 | 2.18E+06 | 3.33E+06 |
| 2-15 | 0.4 | 1600 | −400 | 35 | −160 | −260 | −800 | −140 | −540 | 260 | 940 | 1460 | 2.35E+06 | 3.65E+06 |
| 2-16 | 0.4 | 1600 | −400 | 35 | −160 | −260 | −1000 | −110 | −610 | 390 | 1010 | 1590 | 2.53E+06 | 3.98E+06 |
| 2-17 | 0.4 | 1600 | −400 | 35 | −160 | −260 | −1200 | −80 | −680 | 520 | 1080 | 1720 | 2.70E+06 | 4.30E+06 |
| 2-18 | 0.4 | 1600 | −400 | 35 | −160 | −260 | −1400 | −50 | −750 | 650 | 1150 | 1850 | 2.88E+06 | 4.63E+06 |

*1: Supply potential difference (V)

TABLE 14

| | | Charging amount reduction evaluation result Top row: MS (g/m$^2$), bottom row: PD | | | | | | | | Image evaluation result Top row: MS (g/m$^2$), bottom row: PD | | | |
|---|---|---|---|---|---|---|---|---|---|---|---|---|---|
| Expt No. | Dss (mm) | 150 9.5% | | 200 12.6% | | 300 19.0% | | 400 25.3% | | 150 9.5% | 200 12.6% | 300 19.0% | 400 25.3% |
| 2-12 | 0.4 | C | 6.8 | C | 5.6 | B | 4.5 | B | 4.2 | B | B | B | B |
| 2-13 | 0.4 | C | 6.5 | B | 4.9 | B | 3.9 | B | 3.9 | B | B | B | B |
| 2-14 | 0.4 | C | 5.2 | B | 3.8 | B | 3.5 | B | 3.5 | B | B | B | B |
| 2-15 | 0.4 | B | 4.6 | B | 3.2 | B | 3.1 | B | 3.1 | B | B | B | B |
| 2-16 | 0.4 | A | 3.0 | A | 2.8 | A | 2.6 | A | 2.3 | B | B | B | B |
| 2-17 | 0.4 | A | 2.2 | A | 2.5 | A | 2.3 | A | 2.1 | B | B | B | B |
| 2-18 | 0.4 | A | 1.8 | A | 1.8 | A | 1.5 | A | 1.5 | B | B | B | B |

TABLE 15

| | | Development F2khz | | | | Supply | | | | | Supply, recovery electric field conditions | | | |
|---|---|---|---|---|---|---|---|---|---|---|---|---|---|---|
| Expt No. | Dss (mm) | Vpp (V) | Vdc (V) | Duty (%) | Vave (V) | Vsave (V) | Vspp (V) | Vsdc (V) | Vsmax (V) | Vsmin (V) | *1 | Recovery potential difference (V) | Supply electric field (V/m) | Recovery electric field (V/m) |
| 2-19 | 0.5 | 1600 | −400 | 35 | −160 | −260 | −800 | −140 | −540 | 260 | 940 | 1460 | 1.88E+06 | 2.92E+06 |
| 2-20 | 0.5 | 1600 | −400 | 35 | −160 | −260 | −1000 | −110 | −610 | 390 | 1010 | 1590 | 2.02E+06 | 3.18E+06 |
| 2-21 | 0.5 | 1600 | −400 | 35 | −160 | −260 | −1200 | −80 | −680 | 520 | 1080 | 1720 | 2.16E+06 | 3.44E+06 |
| 2-22 | 0.5 | 1600 | −400 | 35 | −160 | −260 | −1500 | −35 | −785 | 715 | 1185 | 1915 | 2.37E+06 | 3.83E+06 |
| 2-23 | 0.5 | 1600 | −400 | 35 | −160 | −260 | −2000 | 40 | −960 | 1040 | 1360 | 2240 | 2.72E+06 | 4.48E+06 |
| 2-24 | 0.5 | 1600 | −400 | 35 | −160 | −260 | −2200 | 70 | −1030 | 1170 | 1430 | 2370 | 2.86E+06 | 4.74E+06 |

*1: Supply potential difference (V)

TABLE 16

| | | Charging amount reduction evaluation result Top row: MS (g/m$^2$), bottom row: PD | | | | | | | | Image evaluation result Top row: MS (g/m$^2$), bottom row: PD | | | |
|---|---|---|---|---|---|---|---|---|---|---|---|---|---|
| Expt No. | Dss (mm) | 200 10.1% | | 300 15.2% | | 400 20.2% | | 600 30.3% | | 200 10.1% | 300 15.2% | 400 20.2% | 600 30.3% |
| 2-19 | 0.5 | C | 7.2 | C | 6.2 | C | 5.8 | C | 5.5 | B | B | B | B |
| 2-20 | 0.5 | C | 6.5 | C | 5.2 | C | 5.3 | C | 5.1 | B | B | B | B |
| 2-21 | 0.5 | C | 5.5 | B | 4.7 | B | 4.5 | B | 4.2 | B | B | B | B |
| 2-22 | 0.5 | B | 4.8 | B | 3.5 | B | 3.3 | B | 3.1 | B | B | B | B |

TABLE 16-continued

| | | Charging amount reduction evaluation result Top row: MS (g/m$^2$), bottom row: PD | | | | | | | | Image evaluation result Top row: MS (g/m$^2$), bottom row: PD | | | |
|---|---|---|---|---|---|---|---|---|---|---|---|---|---|
| Expt No. | Dss (mm) | 200 10.1% | | 300 15.2% | | 400 20.2% | | 600 30.3% | | 200 10.1% | 300 15.2% | 400 20.2% | 600 30.3% |
| 2-23 | 0.5 | A | 2.9 | A | 2.7 | A | 2.9 | A | 2.6 | B | B | B | B |
| 2-24 | 0.5 | A | 1.8 | A | 2.2 | A | 1.8 | A | 1.9 | B | B | B | B |

From the results of Tables 9 to Table 16, the width of variation of the amount of toner charge after large quantity printing relative to the initial amount of toner charge indicates that there is only very slight change when the supply electric field is more than $2.5\times10^6$ V/m thereby indicating very good results. This is considered to be because, when the supply electric field increases, the opposite polarity particles adhered to the toner particles (strontium titanate, in the case) get separated and easily get recovered into the developer tank. Because the opposite polarity particles are recovered into the developer tank, reduction in the amount of toner charge due to carrier deterioration is compensated for, and it is evident that there is the effect of suppressing changes in the amount of toner charge during large quantity printing. In addition, even the image after printing 50,000 sheets has not deteriorated and the result is good similar to the initial condition.

In order to consider the state in which the opposite polarity particles in the developer are separated due to the supply electric field, the developer used in Experimental Example 2 was used to form a toner layer including opposite polarity particles on one electrode of a two flat parallel plate electrodes (not shown in the figure), and the electric field strength and the amount of separated opposite polarity particles are measured.

The gap between the two electrodes was made 0.2 mm and the condition of applying the voltage was from 0 to 1400 V.

Figure 7:
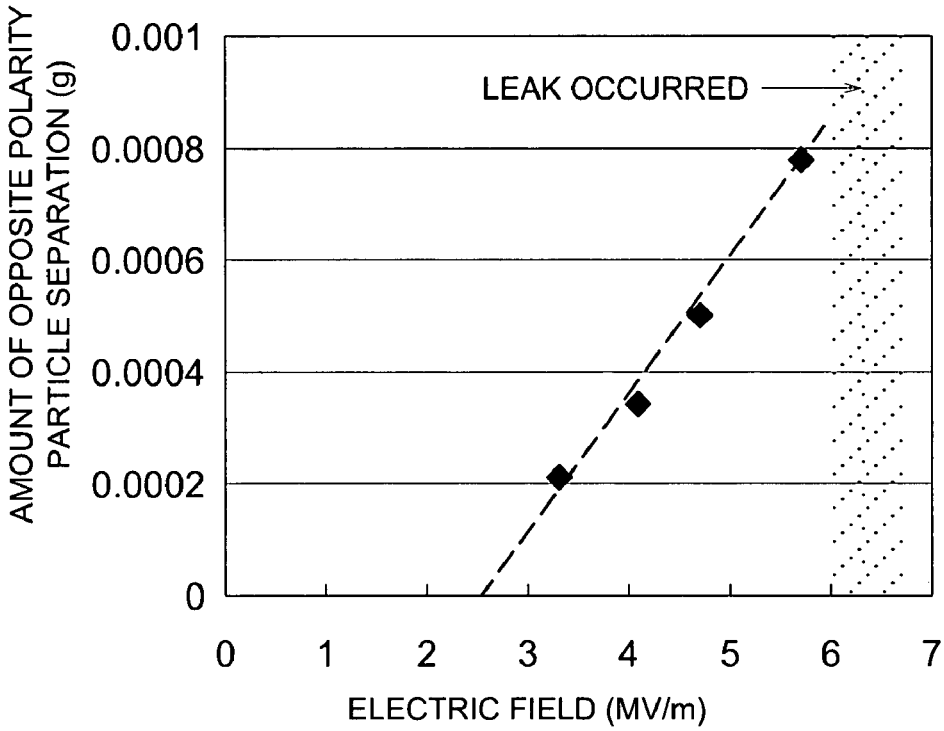
FIG. 7 shows the relationship between the separation electric field strength of the opposite polarity particles and the amount of separation.

The results of measuring the amount of opposite polarity particles that got separated and transferred onto the other electrode are shown in FIG. 7.

From FIG. 7 it became clear that the amount of opposite polarity particles separated due to the electric field started rising from about $2.5\times10^6$ V/m, and the amount increased as the electric field was made stronger. From the above, it is clear that in order to separate by electric field application the opposite polarity particles in a toner, it is necessary to apply an electric field equal to or more than $2.5\times10^6$ V/m, and in order to improve the separation and recovery of the opposite polarity particles, it is effective to apply an electric field of $2.5\times10^6$ V/m or more, which corresponds well with the result of the Experimental Example 2.

Further, although the separation of opposite polarity particles gets improved as the supply electric field becomes larger, a leak phenomenon occurred at electric fields of $6.0\times10^6$ V/m or more in parallel flat plate electrodes.

In this manner, in a developer that includes opposite polarity particles, in addition to the conditions shown in Experimental Example 1, the consumption of opposite polarity particles is suppressed by making the supply electric field equal to or more than $2.5\times10^6$ V/m but equal to or less than $6\times10^6$ V/m, lowering of the chargeability of carriers due to large volume printing is compensated for, the amount of toner charge is maintained stable from the initial condition during large volume printing, and it is possible to obtain good images.

It goes without saying that it is possible to form good images over a long time without any residual images (memory phenomenon) being produced without any complex controls even without a recovery operation or control of temporarily recovering the toner on a toner supporting member and resetting in between images (between sheets).

What is claimed is:

1. A development apparatus, comprising:

a developer supporting member which supports developer containing toner and magnetic carrier on a surface of the developer supporting member to convey the developer, wherein the developer supporting member comprises a rotatable sleeve in which a magnet body is fixedly arranged;

a toner supporting member which is disposed facing the developer supporting member to receive the toner transferred from the developer supporting member onto a surface of the toner supporting member, to convey the toner to a development area, wherein the developer forms a magnetic brush on the developer supporting member so as to rub the toner supporting member, the toner having passed through the development area is collected onto the developer supporting member by the developer rubbing the toner supporting member, and the surface of the toner supporting member travels in a direction opposite a traveling direction of the surface of the developer supporting member at an opposing portion between the toner supporting member and the developer supporting member; and an electric field forming mechanism which is adapted to form an alternating electric field between the developer supporting member and the toner supporting member, wherein a strength of an electric field in a direction in which the toner is collected from the toner supporting member onto the developer supporting member is in a range from $2.5\times10^6$ V/m to $5\times10^6$ V/m at a closest portion between the developer supporting member and the toner supporting member, and a packing density PD of the developer in a space at the closest portion between the developer supporting member and the toner supporting member satisfies the following relationship, $$0.09 \leqq PD \leqq 650\times Dss \text{ wherein,}$$

$$PD = M/(\rho\times Dss);$$

M (g/m$^2$) is an amount of the developer on the developer supporting member;

Dss (m) is a smallest spacial distance between the developer supporting member and the toner supporting member;

ρ (g/m$^3$) is a density of the developer, ρ satisfying the equation $$\rho=\rho t\times TC+\rho c\times(1-TC);$$

ρt (g/m$^3$) is a density of the toner;

ρc (g/m$^3$) is a density of the carrier; and

TC is a mass ratio of the toner in the developer.

2. The development apparatus of claim 1, wherein a strength of an electric field in a direction in which the toner is supplied from the developer supporting member onto the toner supporting member is in a range from $2.5\times10^6$ V/m to $6\times10^6$ V/m at the closest portion between the developer supporting member and the toner supporting member.

3. The development apparatus of claim 1, wherein the developer contains opposite polarity particles which are different from the toner and the carrier and are charged in an opposite polarity to a polarity of electrostatic charge of the toner.

4. The development apparatus of claim 3, wherein a strength of an electric field in a direction in which the toner is supplied from the developer supporting member onto the toner supporting member is in a range from $2.5\times10^6$ V/m to $6\times10^6$ V/m at the closest portion between the developer supporting member and the toner supporting member.

5. The development apparatus of claim 3, wherein a number average particle diameter of the toner is from 3 to 15 μm, and a number average particle diameter of the opposite polarity particles is from 100 to 1000 nm.

6. An image forming apparatus, comprising:

an image carrier;

an electrostatic latent image forming mechanism which is adapted to form an electrostatic latent image on the image carrier;

a development apparatus which is adapted to develop the electrostatic latent image on the image carrier to form a toner image, the development apparatus including:

a developer supporting member which supports developer containing toner and magnetic carrier on a surface of the developer supporting member to convey the developer;

a toner supporting member which is disposed facing the developer supporting member to receive the toner transferred from the developer supporting member onto a surface of the toner supporting member, to convey the toner to a development area, wherein the developer supporting member including a magnet body therein, the developer forms a magnetic brush on the developer supporting member so as to rub the toner supporting member, the toner having passed through the development area is collected onto the developer support member by the developer rubbing the toner supporting member, and the surface of the toner supporting member travels in a direction opposite of a traveling direction of the surface of the developer supporting member at an opposing portion between the toner supporting member and the developer supporting member;

an electric field forming mechanism which is adapted to form an alternating electric field between the developer supporting member and the toner supporting member, wherein a strength of an electric field in a direction in which the toner is collected from the toner supporting member onto the developer supporting member is in a range from $2.5\times10^6$ V/m to $5\times10^6$ V/m at a closest portion between the developer supporting member and the toner supporting member, and an image transfer mechanism which is adapted to transfer the toner image formed on the image carrier onto a recording medium;

wherein a packing density PD of the developer in a space at the closest portion between the developer supporting member and the toner supporting member satisfies the following relationship, $$0.09\leqq PD\leqq 650\times Dss \text{ wherein,}$$

$$PD=M/(\rho\times Dss);$$

M (g/m$^2$) is an amount of the developer on the developer supporting member;

Dss (m) is a smallest spacial distance between the developer supporting member and the toner supporting member;

ρ (g/m$^3$) is a density of the developer, ρ satisfying the equation $$\rho=\rho t\times TC+\rho c\times(1-TC);$$

ρt (g/m$^3$) is a density of the toner;

ρc (g/m$^3$) is a density of the carrier; and

TC is a mass ratio of the toner in the developer.

7. A developing method, comprising:

causing a developer supporting member to support developer containing toner and magnetic carrier, the developer supporting member including a magnet body therein;

causing a surface of a toner supporting member, which is disposed facing the developer supporting member, to travel in a direction opposite to a traveling direction of a surface of the developer supporting member at an opposing portion between the toner supporting member and the developer supporting member, wherein the developer forms a magnetic brush on the developer supporting member so as to rub the toner supporting member;

forming an alternating electric field between the developer supporting member and the toner supporting member so that the strength of the electric field in a direction in which the toner is collected from the toner supporting member onto the developer supporting member by the developer rubbing the toner supporting member is in a range from $2.5\times10^6$ V/m to $5\times10^6$ V/m at a closest portion between the developer supporting member and the toner supporting member, and setting a packing density PD of the developer in a space at the closest portion between the developer supporting member and the toner supporting member so as to satisfy the following relationship, $$0.09\leqq PD\leqq 650\times Dss \text{ wherein,}$$

$$PD=M/(\rho\times Dss);$$

M (g/m$^2$) is an amount of the developer on the developer supporting member;

Dss (m) is a smallest spacial distance between the developer supporting member and the toner supporting member;

ρ (g/m$^3$) is a density of the developer, ρ satisfying the equation $$\rho\times\rho t\times TC+\rho c\times(1-TC);$$

ρt (g/m$^3$) is a density of the toner;

ρc (g/m$^3$) is a density of the carrier; and

TC is a mass ratio of the toner in the developer.

8. The developing method of claim 7, wherein the alternating electric field is formed so that a strength of an electric field in a direction in which the toner is supplied from the developer supporting member onto the toner supporting member is in a range from $2.5\times10^6$ V/m to $6\times10^6$ V/m at the closest portion between the developer supporting member and the toner supporting member.

9. The developing method of claim 7, wherein the developer contains opposite polarity particles which are different from the toner and the carrier and are charged in an opposite polarity to a polarity of electrostatic charge of the toner.

10. The developing method of claim 9, wherein the alternating electric field is formed so that a strength of an electric field in a direction in which the toner is supplied from the developer supporting member onto the toner supporting member is in a range from $2.5\times10^6$ V/m to $6\times10^6$ V/m at the closest portion between the developer supporting member and the toner supporting member.

* * * * *